US008012279B2

(12) United States Patent
Thiel et al.

(10) Patent No.: US 8,012,279 B2
(45) Date of Patent: Sep. 6, 2011

(54) LABELING METHOD AND DEVICE

(75) Inventors: Roger Thiel, Weinstadt (DE); Thomas Osswald, Filderstadt (DE); Reiner Mannsperger, Spiegelberg (DE)

(73) Assignee: Herma GmbH, Filderstadt (DE)

( * ) Notice: Subject to any disclaimer, the term of this patent is extended or adjusted under 35 U.S.C. 154(b) by 1421 days.

(21) Appl. No.: 10/556,713

(22) PCT Filed: Sep. 3, 2004

(86) PCT No.: PCT/EP2004/009826
§ 371 (c)(1),
(2), (4) Date: Nov. 9, 2005

(87) PCT Pub. No.: WO2005/037654
PCT Pub. Date: Apr. 28, 2005

(65) Prior Publication Data

US 2006/0289106 A1 Dec. 28, 2006

(30) Foreign Application Priority Data

Sep. 20, 2003 (DE) ..... 103 45 340

(51) Int. Cl.
*B65C 9/42* (2006.01)

(52) U.S. Cl. ..... 156/64; 156/269; 156/289; 156/268; 156/351; 156/363; 156/556; 156/566

(58) Field of Classification Search ..... 156/363, 156/361, 64, 351, 540, 362, 542, 566, 556, 156/541, 567, 568, 268, 269, 289
See application file for complete search history.

(56) References Cited

U.S. PATENT DOCUMENTS 4,267,004 A 5/1981 Anderson ..... 156/361
4,294,644 A 10/1981 Anderson ..... 156/361
(Continued)

FOREIGN PATENT DOCUMENTS

DE 31 03 395 A1 1/1982
(Continued)

OTHER PUBLICATIONS

Quantum Leaps LLC, "Quantum Platform Overview," Palo Alto CA, © 2005, pp. 1-11.

(Continued)

*Primary Examiner* — Khanh Nguyen
*Assistant Examiner* — Keith T Aziz
(74) *Attorney, Agent, or Firm* — Milton Oliver, Esq.; Oliver Intellectual Property LLC

(57) ABSTRACT

In a method for labeling, a label strip (20) is moved by means of an electric motor (80). Arranged on this label strip are labels (26) of predetermined length (EL) with uniform interstices (SB). The motor has associated with it a position controller (218), also a sensor (44) for sensing a predetermined position of a label (26) when the latter is moved on the label strip (20) relative to the sensor (44). The method has the following steps: in accordance with a stored profile, the label strip (20) is set in motion beginning from a start position (A), a first target position (Z) of the label strip being specified to the position controller (218); during the motion of the label strip (20), a predetermined position (M) of the label strip (20) is sensed; and subsequently thereto, a revised target position (Z) is specified to the position controller (218). This makes possible fast and precise labeling, since the target position can be reached very accurately. A corresponding device has a compact design.

51 Claims, 15 Drawing Sheets

U.S. PATENT DOCUMENTS

| | | | | | |
|---|---|---|---|---|---|
| 4,422,376 | A | | 12/1983 | Teraoka | 101/69 |
| 4,434,911 | A | | 3/1984 | Sakura | 221/2 |
| 4,544,287 | A | | 10/1985 | Teraoka | 400/120 |
| 4,585,505 | A | | 4/1986 | Matsuguchi | 156/361 |
| 4,717,059 | A | | 1/1988 | Takahashi | 226/2 |
| 4,724,347 | A | | 2/1988 | Reinhardt | 310/68 |
| 5,674,335 | A | * | 10/1997 | Aman et al. | 156/64 |
| 5,697,539 | A | | 12/1997 | Furuya | 226/11 |
| 5,803,624 | A | | 9/1998 | Miazga | 400/103 |
| 5,888,343 | A | * | 3/1999 | Olson | 156/556 |
| 5,895,555 | A | | 4/1999 | Van Den Bergh | 156/556 |
| 6,169,481 | B1 | * | 1/2001 | Goldberg et al. | 340/572.1 |
| 6,323,573 | B1 | * | 11/2001 | Pinkerton | 310/178 |
| 6,428,639 | B1 | | 8/2002 | Oldenburg | 156/64 |
| 6,558,490 | B2 | | 5/2003 | Klein | 156/64 |
| 6,563,280 | B2 | | 5/2003 | Firehammer et al. | 318/560 |
| 6,601,371 | B1 | | 8/2003 | Fertig | 53/504 |
| 7,519,440 | B2 | * | 4/2009 | Weinhofer et al. | 700/61 |
| 2001/0054470 | A1 | | 12/2001 | Firehammer | 156/64 |
| 2002/0096241 | A1 | | 7/2002 | Instance | 156/64 |
| 2002/0096264 | A1 | | 7/2002 | Yang | 156/556 |
| 2003/0034111 | A1 | * | 2/2003 | Oldenburg et al. | 156/64 |

FOREIGN PATENT DOCUMENTS

| | | | |
|---|---|---|---|
| DE | 32 03 162 | A1 | 8/1983 |
| DE | 32 03 162 | A1 | 8/1983 |
| DE | 32 15 288 | A1 | 11/1983 |
| DE | 32 15 288 | C2 | 11/1983 |
| DE | 195 22 295 | A1 | 1/1997 |
| DE | 195 22 295 | C2 | 1/1997 |
| DE | 198 41 138 | A1 | 11/1999 |
| DE | 198 41 138 | A1 | 11/1999 |
| DE | 69606313 | T | 9/2000 |
| EP | 0 046 365 | | 2/1982 |
| EP | 0 085 418 | | 8/1983 |
| EP | 0 109 206 | | 5/1984 |
| EP | 0 248 375 | | 12/1987 |
| EP | 0 248 375 | B1 | 8/1990 |
| EP | 0 699 608 | B1 | 5/2001 |

OTHER PUBLICATIONS

Texas Instruments, "2407 DSP Controllers", Houston TX, © 2002, pp. 1-12 and 111-115.

Tex. Instr., Application Report SPRA588, Sep. 1999, pp. 1-86, downloaded Sep. 2010 from www.TI.COM/SC/DOCS.

Merz & Jaschek,"Grundkurs der Regelungstechnik," [Basic Course In Control Technology],8th Edition, 1985 , pp. 50-55, publ. by R. Oldenbourg Verlag of Munich & Vienna; Int'l. Standard Book No. 3-486-35388-8.

* cited by examiner

218
PG
PI s-CTL
PI n-CTL
PI i-CTL
PI i-CTL
FF Accel.
FF v soll
dv/dt
ds/dt
dq
dq
PMSM
Enc.
RS422 Receiver
Kon-verter
QEP
S1
S2
TW

LABELING METHOD AND DEVICE

CROSS-REFERENCE

This application is a section 371 of PCT/EP2004/009826, filed 3 Sep. 2004 and published 28 Apr. 2005 as WO 2005-037654-A2.

FIELD OF THE INVENTION

The present invention relates to a method and an apparatus for labeling.

BACKGROUND

When labels are to be dispensed from a carrier strip at a dispensing edge, also called a detaching edge, the following factors, among others, play an important role:

a) The speed of the dispensing operation. This determines the labeling speed, i.e. how many boxes, cans, bottles, etc. can be labeled per minute.

b) The accuracy of the dispensing operation. What is important here is to place the label accurately at a desired location, for example on a suction device that transfers the label onto an object that is to be labeled, or also to apply the label accurately and without folds at a desired point, directly onto an object to be labeled that is passing by.

Known methods for moving a label strip work in the manner of an open-loop control system, i.e. a label sensor is used that is mounted at a specific location on a labeling device, preferably very close to the location where the labels are dispensed. This location is ascertained empirically by the person setting up the machine. When a label arrives at this sensor, the latter generates a pulse that is then used to shut off the drive system.

Such methods yield entirely acceptable results, but problems occur at higher speeds, principally for the following reasons:

Forces act on the label strip/carrier strip from outside, for example from moving, resilient pendulums on the supply spool and on the spool that takes up the carrier strip. These forces, whose occurrence is governed by chance, can accelerate or decelerate the label strip, which can lead to corresponding labeling errors.

During the motion of the label strip/carrier strip, the latter can expand or contract similarly to a rubber band, particularly at the beginning of a transport motion; this "rubber band effect" can likewise negatively affect labeling accuracy and limits the labeling speed, since such effects increase with increasing speed. This is because higher speeds result in correspondingly higher accelerations, and thus in greater forces on the label strip/carrier strip.

SUMMARY OF THE INVENTION

It is an object of the invention to make available a new method and a new apparatus for labeling.

According to a first aspect of the invention, this object is achieved by controlling motion of a label strip, using a position controller in conjunction with a label position sensor. In the context of the invention, therefore, after a part of the motion sequence has elapsed, the target position at which the motion is intended to be complete is redefined at a predetermined location on the label strip (e.g. at a label edge) while the motor is running. This is achieved, for example, by the fact that at the predetermined location, a defined residual distance, also called a follow-on distance, is inputted into the controller as the target position. This residual distance is usually defined by the user, e.g. 13 mm from a specific physical feature of a label or carrier strip, for example from an edge, a hole, a marking, etc. After passing the predetermined location the label strip then moves another 13 mm and remains stationary after those 13 mm, and that 13-mm spacing is maintained without modification for one label after another.

According to a second aspect of the invention, the stated object is achieved by first specifying a target position for the label and, during the label's motion, specifying a revised target position. By accurate specification of the residual distance, such an arrangement makes possible very precise labeling even if the label pitch varies slightly due to fluctuations in production, changes in relative humidity, etc.

Accurate maintenance of a residual distance during labeling has the following principal advantages:

a) The accuracy of the motion sequence is decisively enhanced.

b) The reproducibility of the motion sequence becomes very good.

c) So-called pitch errors in the label strip now play only a subordinate role, since they can be largely suppressed by appropriate selection of the predetermined measurement location.

d) By modifying the residual distance it is very easy to adjust the position occupied by a label at the end of a motion operation.

e) A labeling apparatus, a label printer, or the like can in many cases be set to a different label format with no need to modify the position of the label sensor that is used.

f) Labels missing from the label strip can be "skipped," i.e. the machine continues to run despite the missing information, and is not shut off by the error. If a label is missing from the label strip, an object to be labeled will pass through the machine without being labeled, but this does not change the precision of subsequent labeling operations.

g) It is possible to stipulate that an alarm is generated when, for example, three labels in succession are missing from the label strip, but not when only one or two are missing.

h) The capability of automatically detecting a tear in the label strip is created, since no signal is then generated at the predetermined measurement location.

According to a third aspect of the invention, this object is achieved by imparting a predetermined motion profile, having multiple phases, to the label's motion. A method of this kind makes possible very fast and precise labeling, changes in the labeling speed being possible without any changes in labeling precision.

A corresponding arrangement is a motor/controller combination which causes a first accelerating motion phase, a second uniform-speed motion phase, and a third braking-to-zero phase. In this arrangement, the shape of the motion profile is automatically adapted when the labeling speed is modified, and precise labeling is consequently always obtained regardless of whether it occurs slowly or quickly.

According to a further aspect of the invention, this object is achieved by using a four-quadrant controller to drive the electric motor.

A very compact and also high-performance labeling device is obtained, according to a further aspect of the invention, by putting the motor and its power electronics in a metal housing which serves as a heat sink or cooling element. The need for additional electrical cabinets, etc. is in many cases thereby eliminated, and costs for the installation of and, if applicable, modifications to a labeling apparatus are consequently low. Cleaning is moreover facilitated, and it is possible to conform to higher electrical protection classes without increased outlay, making it possible to use such labeling devices in refineries and other explosion-hazard facilities.

A drive system of this kind, and a method according to the present invention, can of course also be used for other purposes, e.g. for rapid and precise driving of turntables for beverage filling, or for the labeling of bottles.

Further details and advantageous refinements of the invention are evident from the exemplifying embodiments, in no way to beunderstood as a limitation of the invention, that are described below and depicted in the drawings.

BRIEF FIGURE DESCRIPTION: IN THE DRAWINGS

Figure 3:
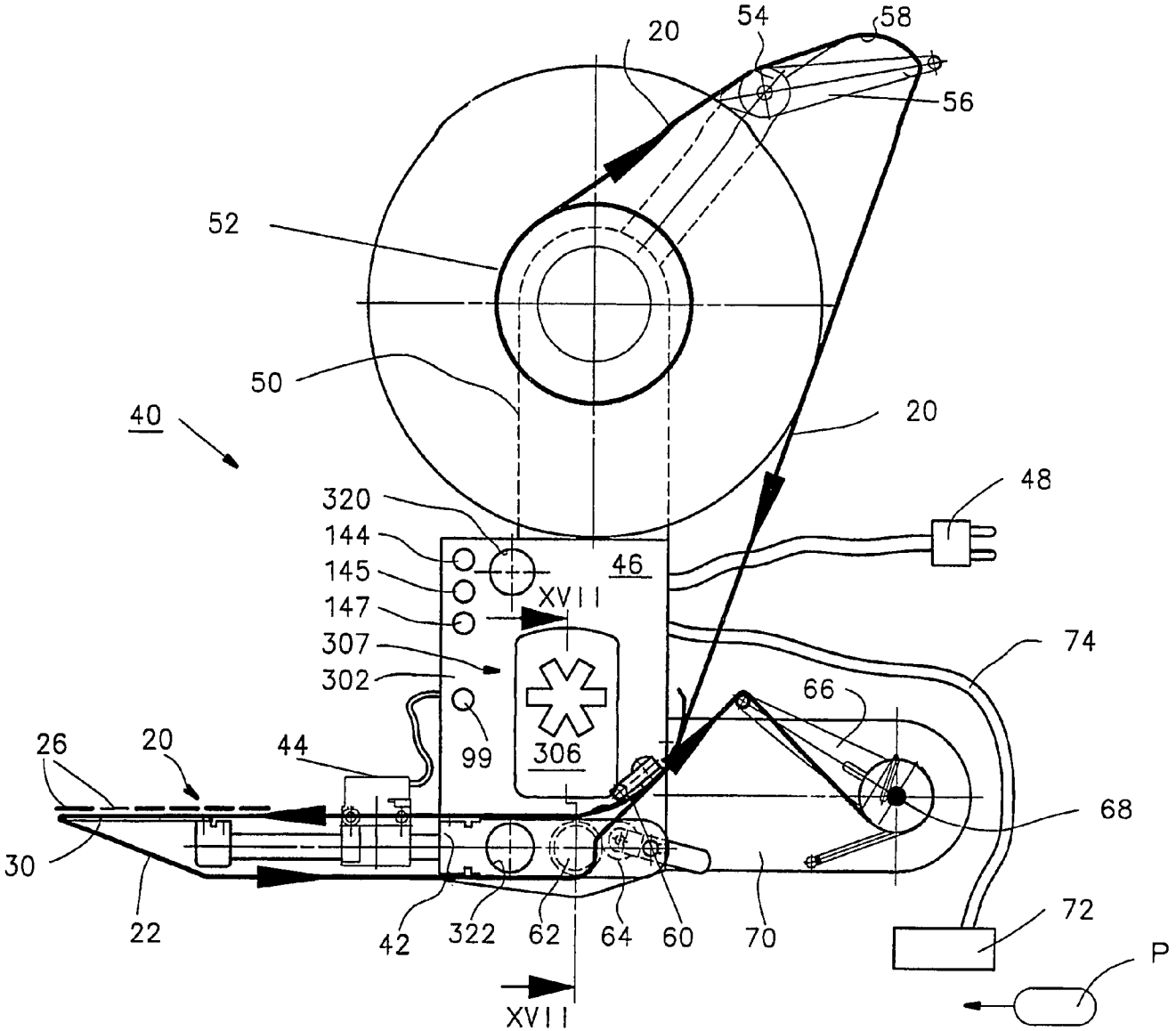
FIG. 3 shows a labeling device according to a preferred embodiment of the invention, which is joined to a dispensing or detaching edge to constitute one functional unit.
Figure 5:
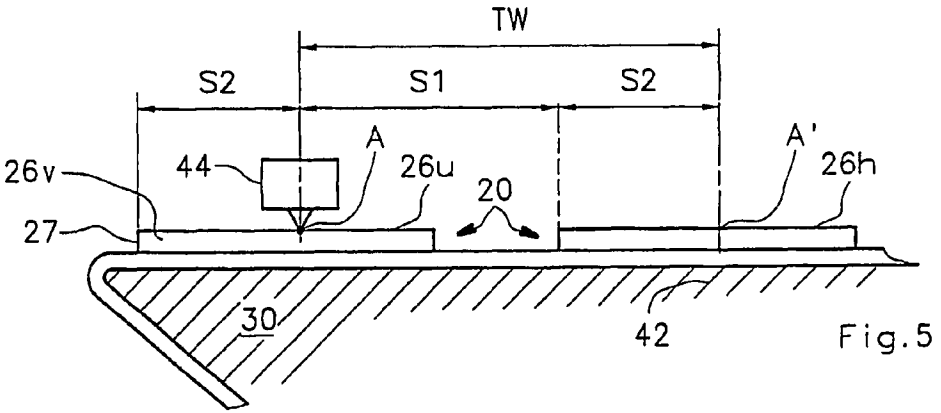
Figure 6:
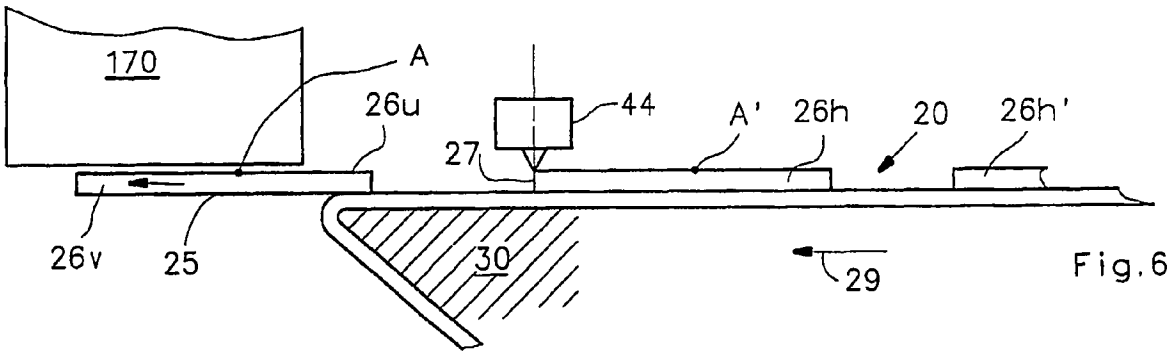
Figure 7:
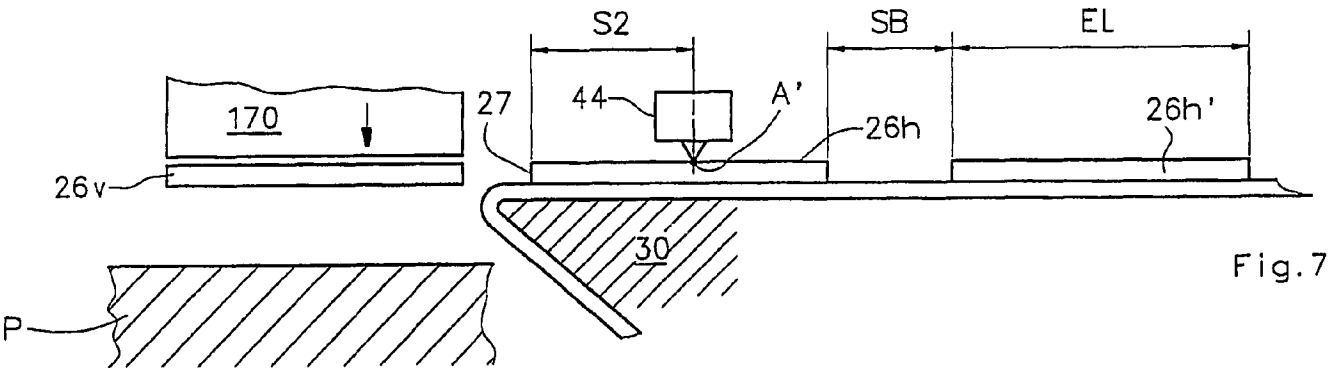
Figure 8:
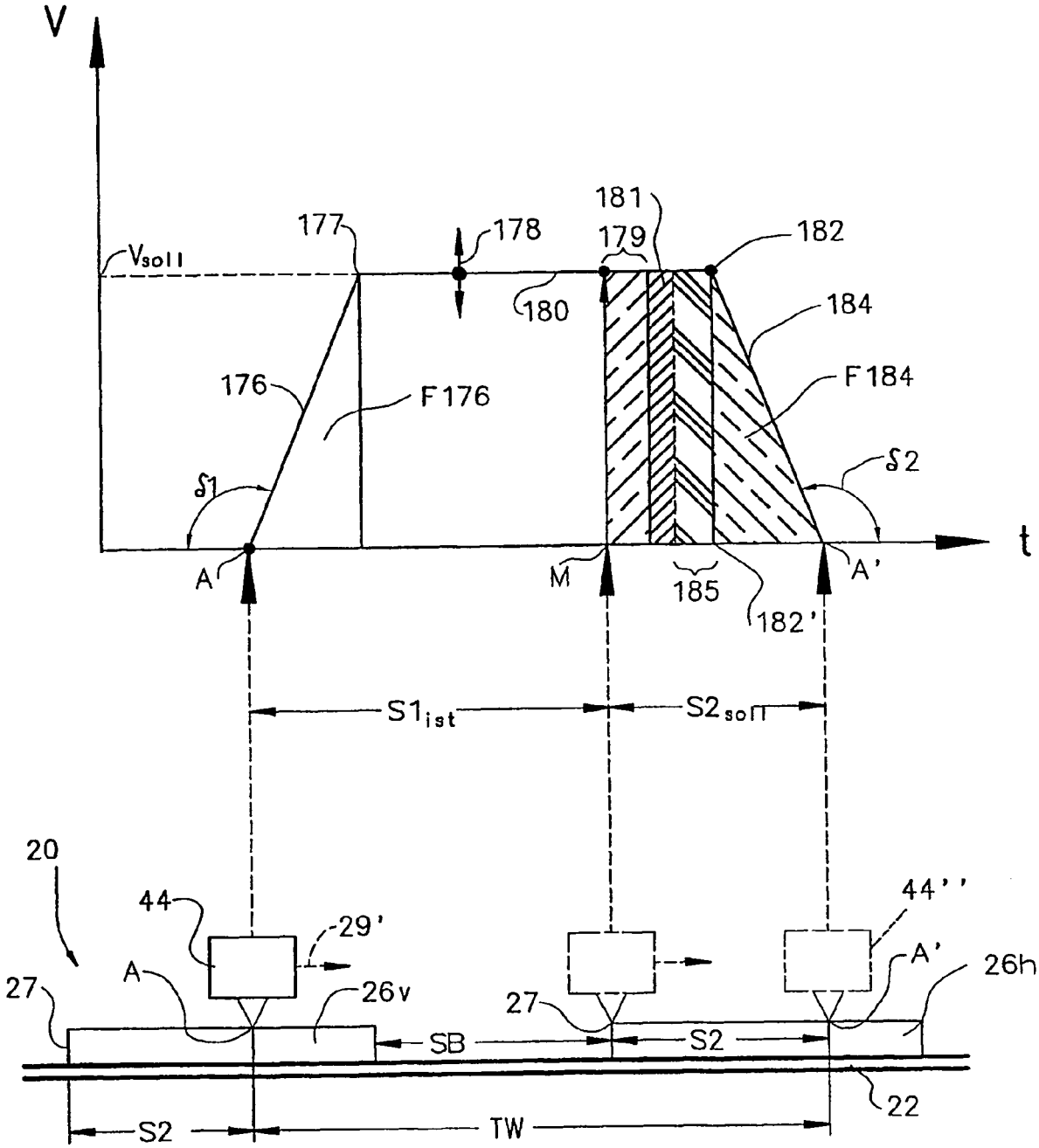
Figure 9:
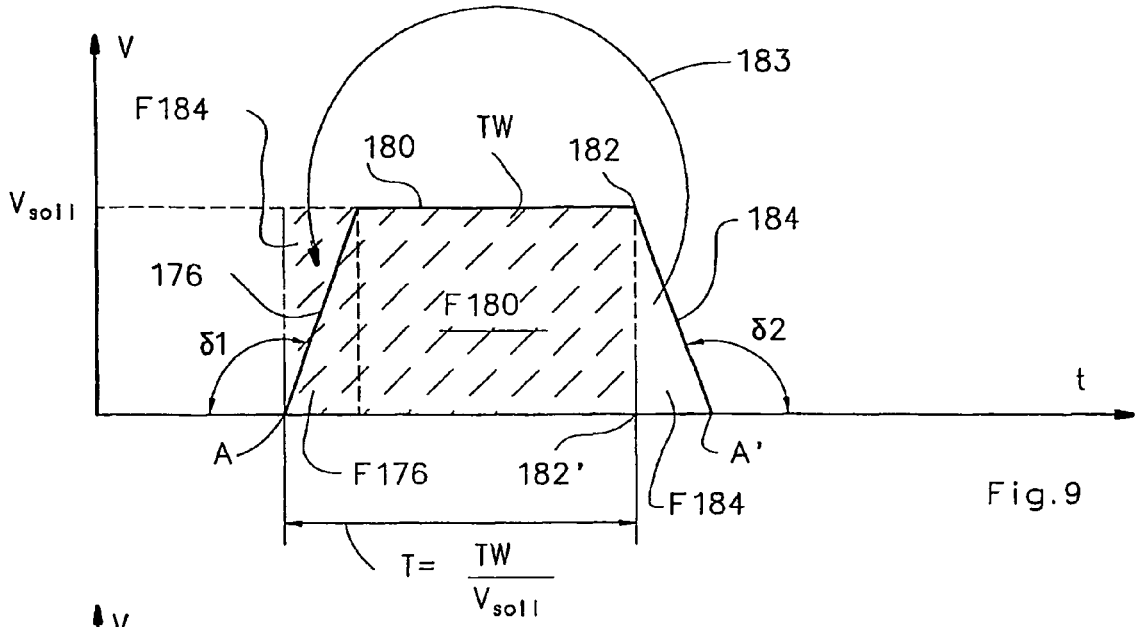
Figure 10:
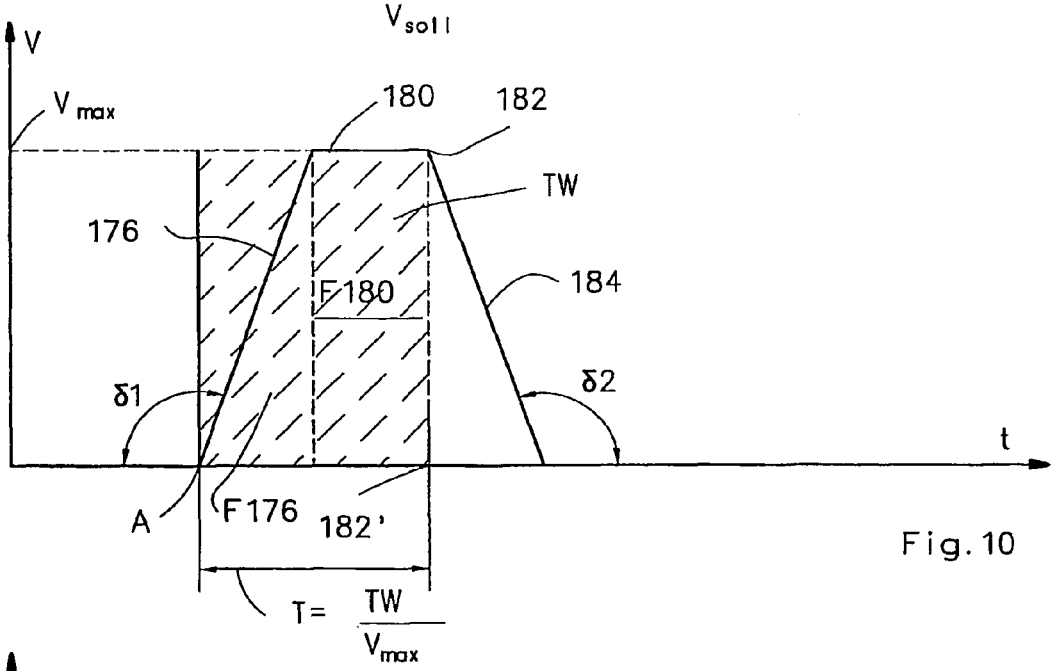
Figure 11:
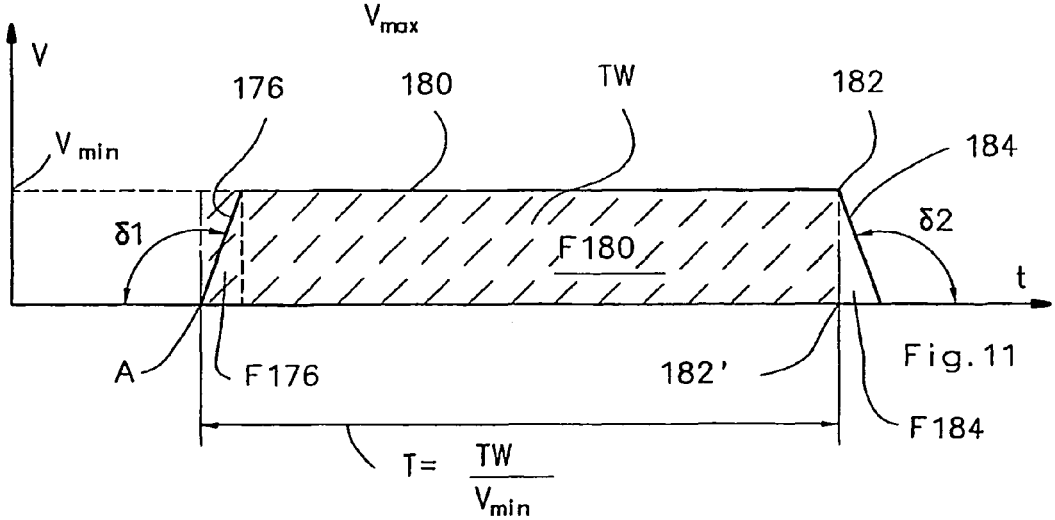
Figure 12:
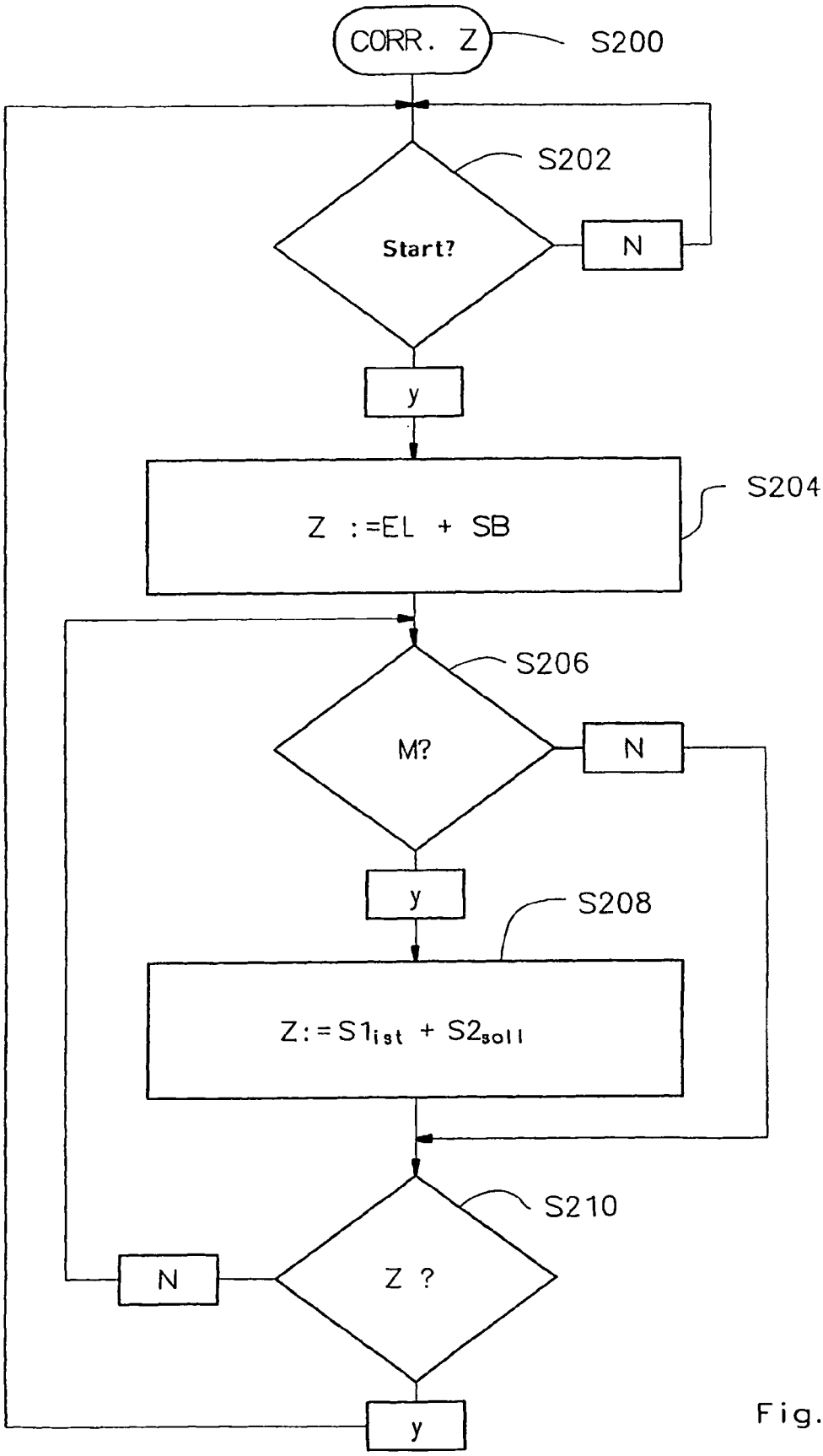
Figure 13:
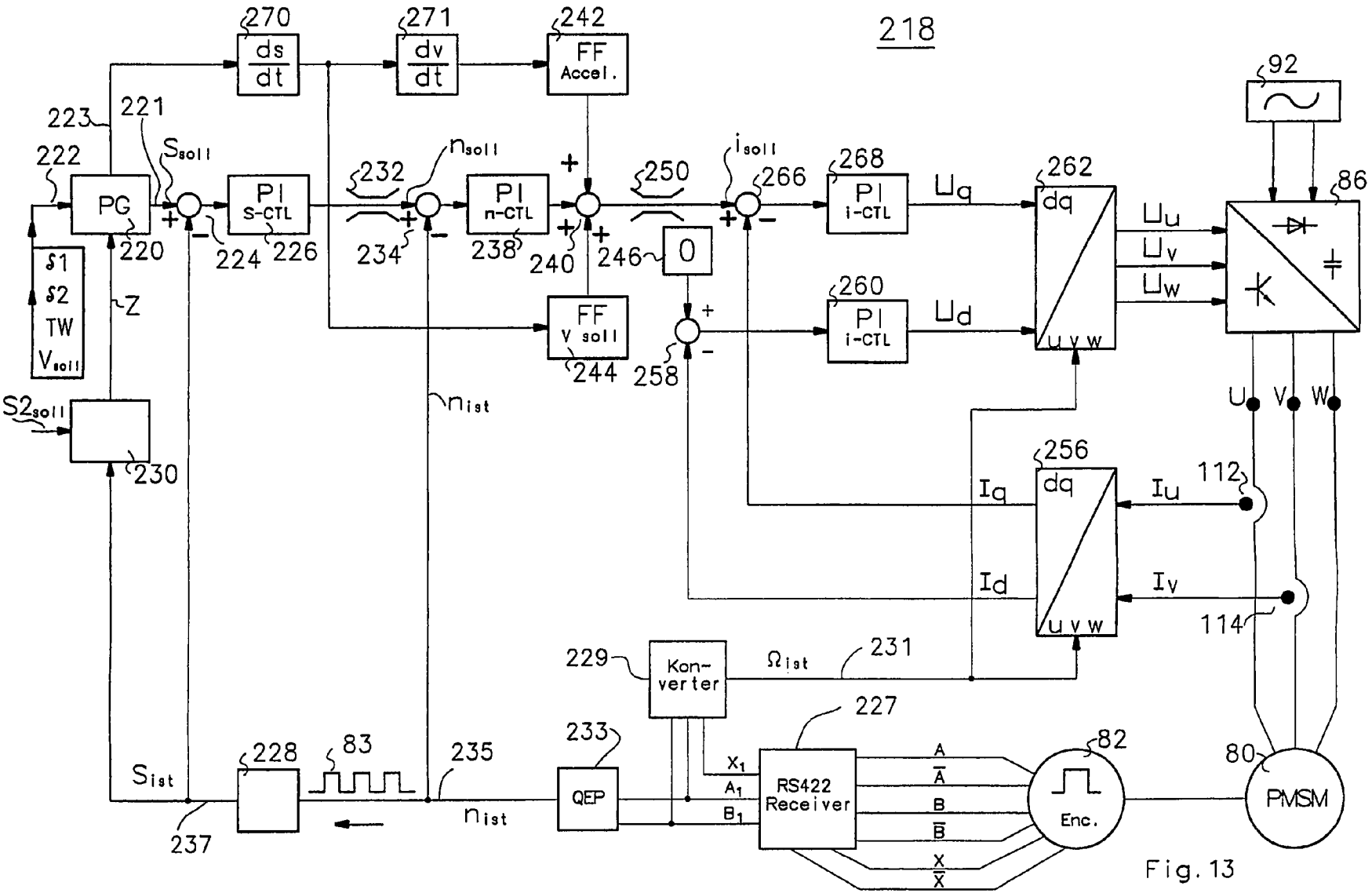
Figure 14:
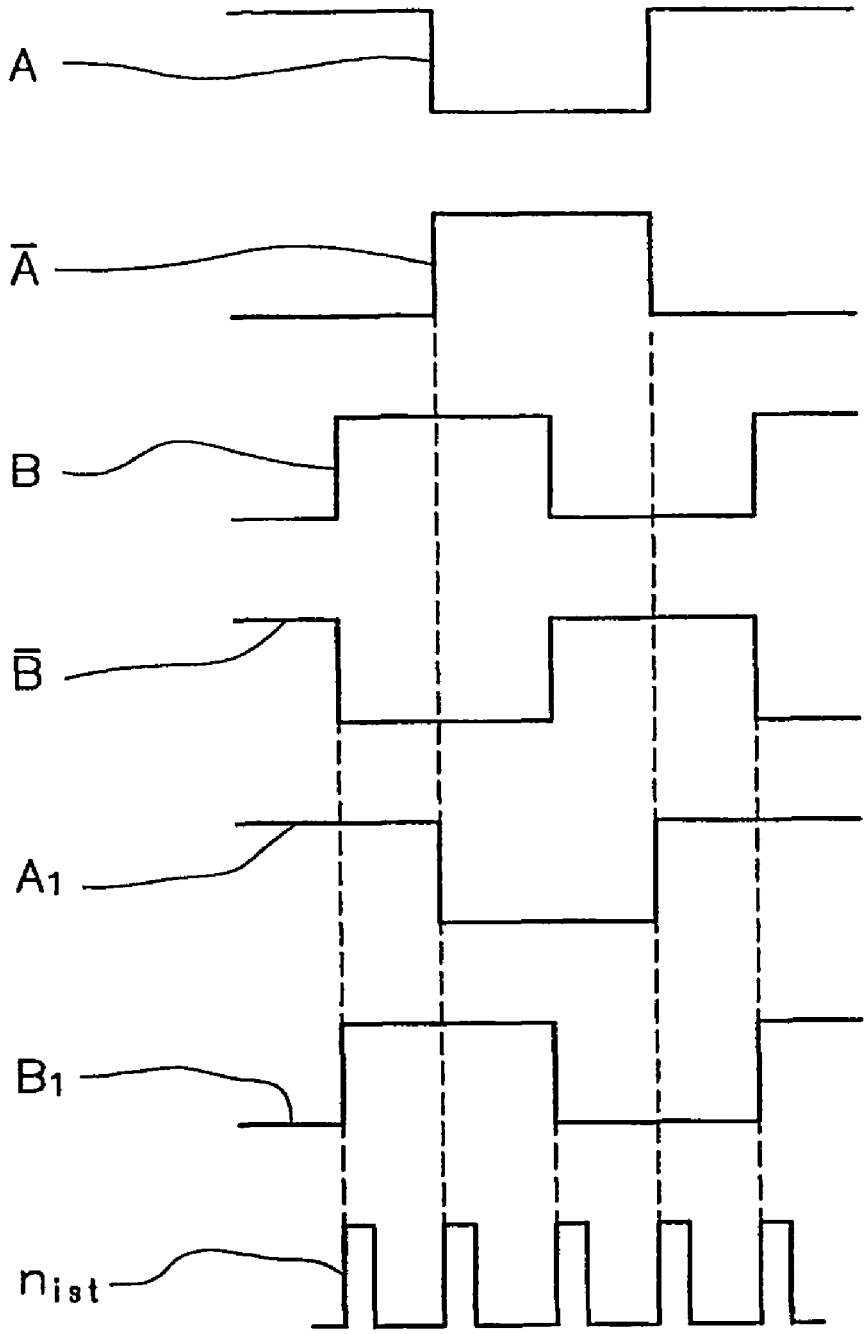
Figure 15:
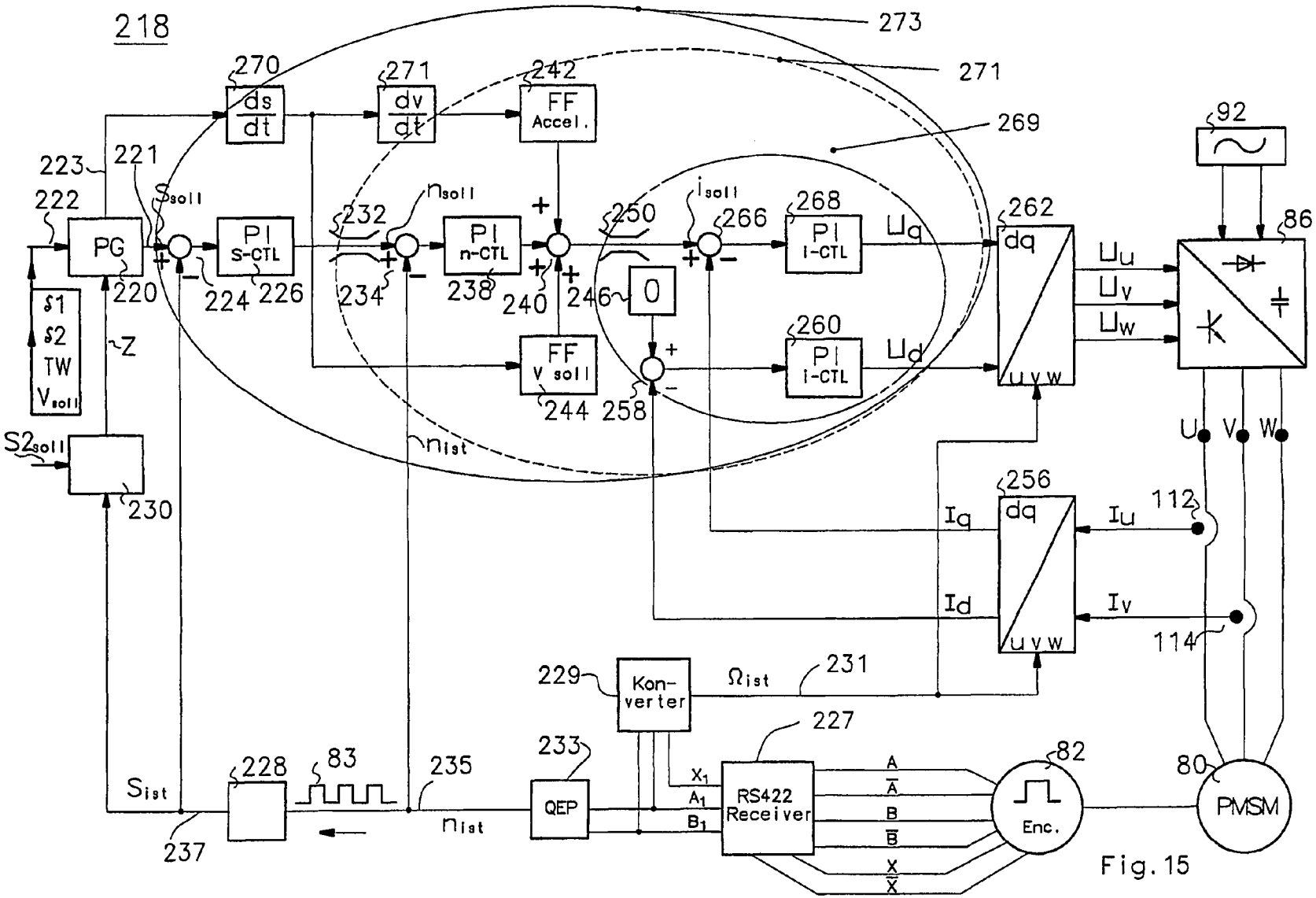
Figure 16:
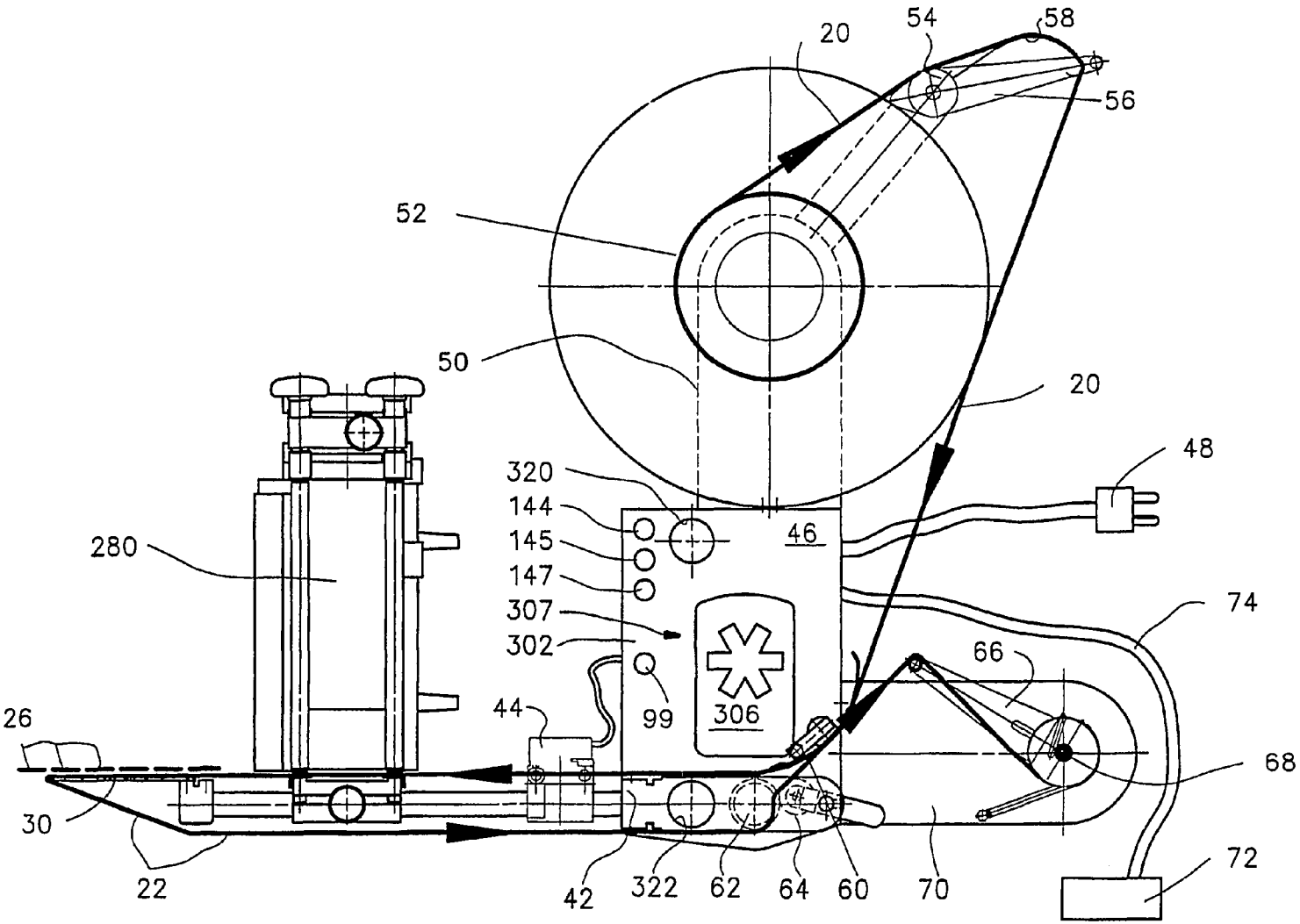
Figure 17:
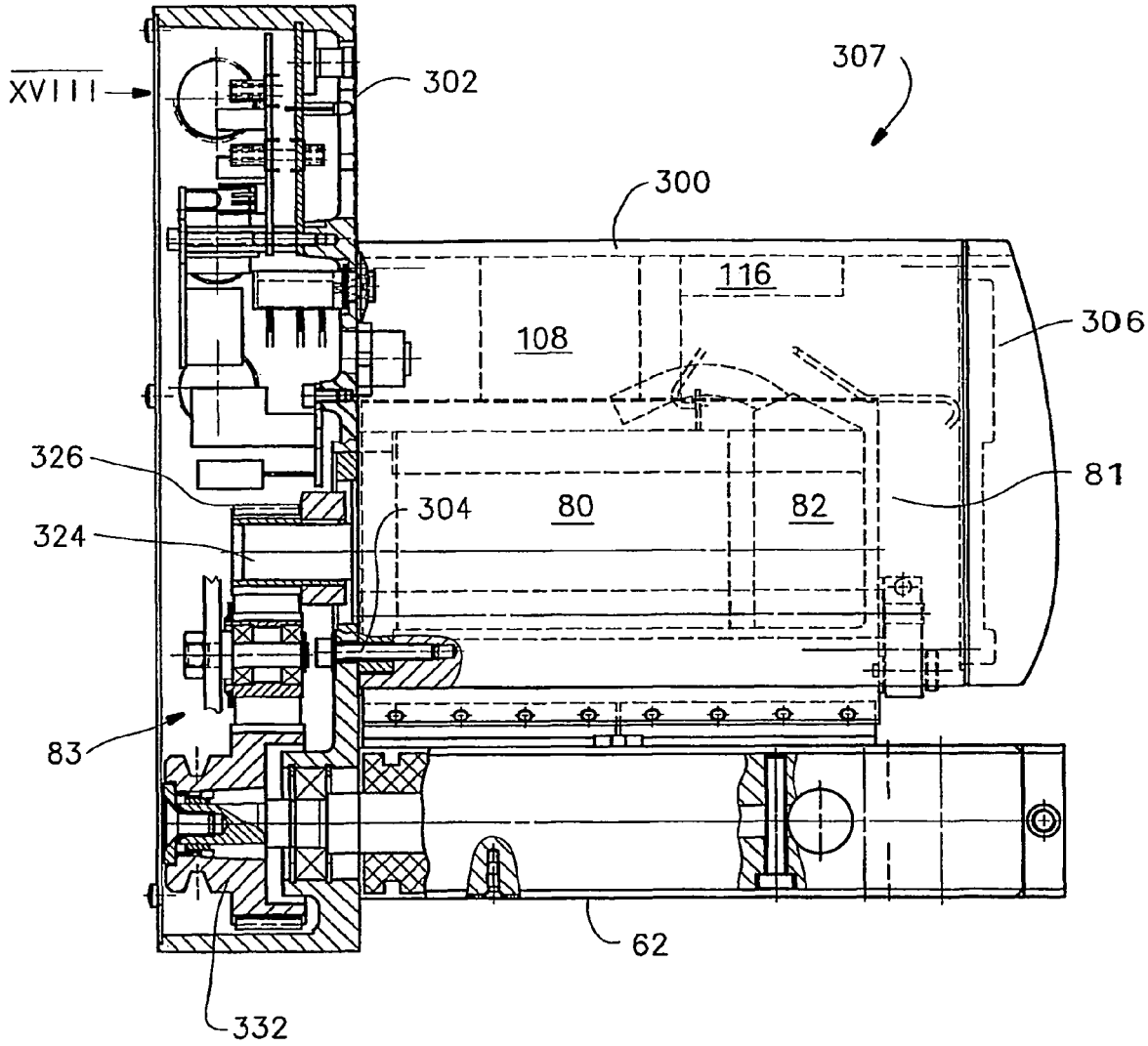
Figure 18:
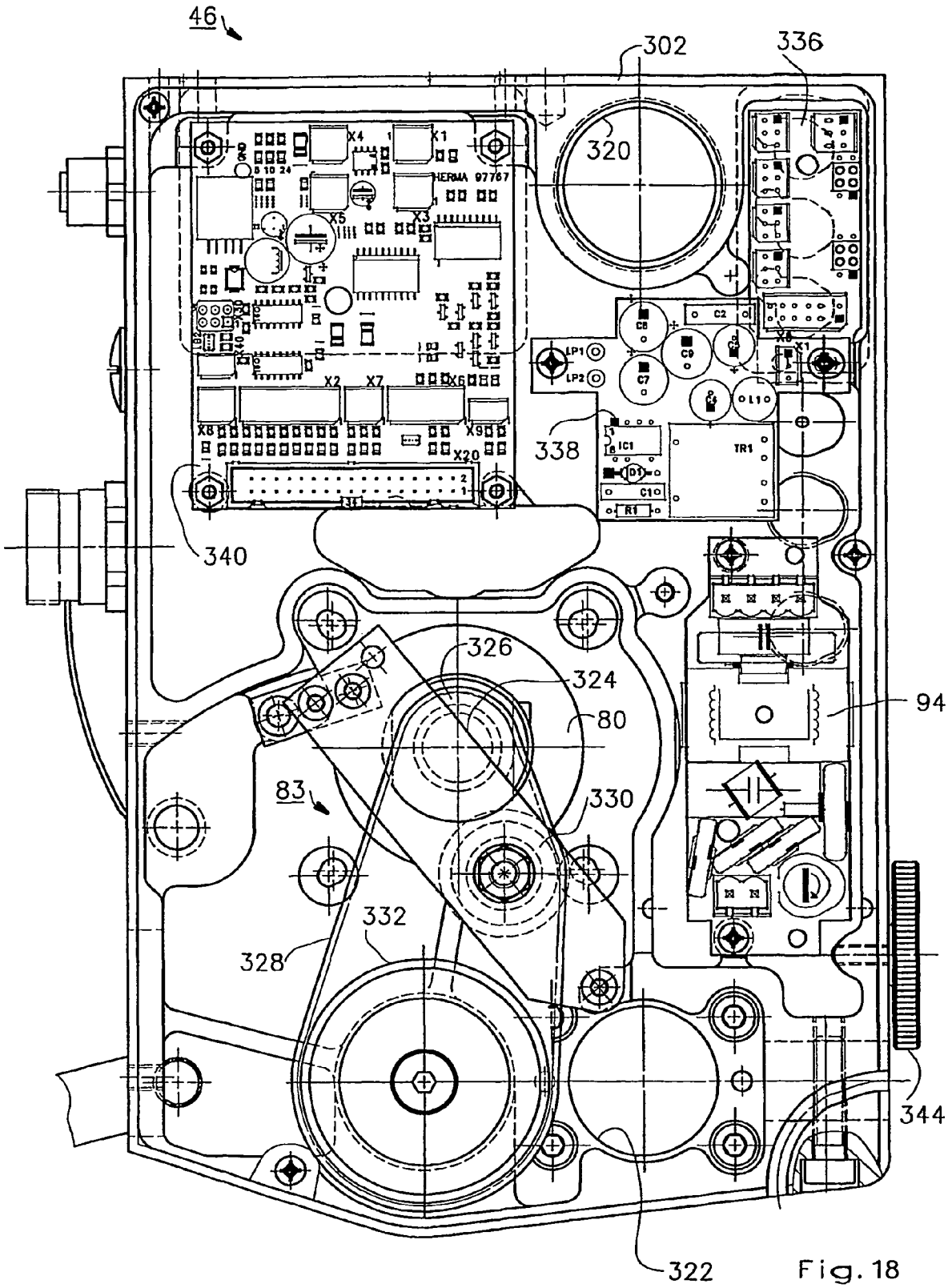
Figure 19:
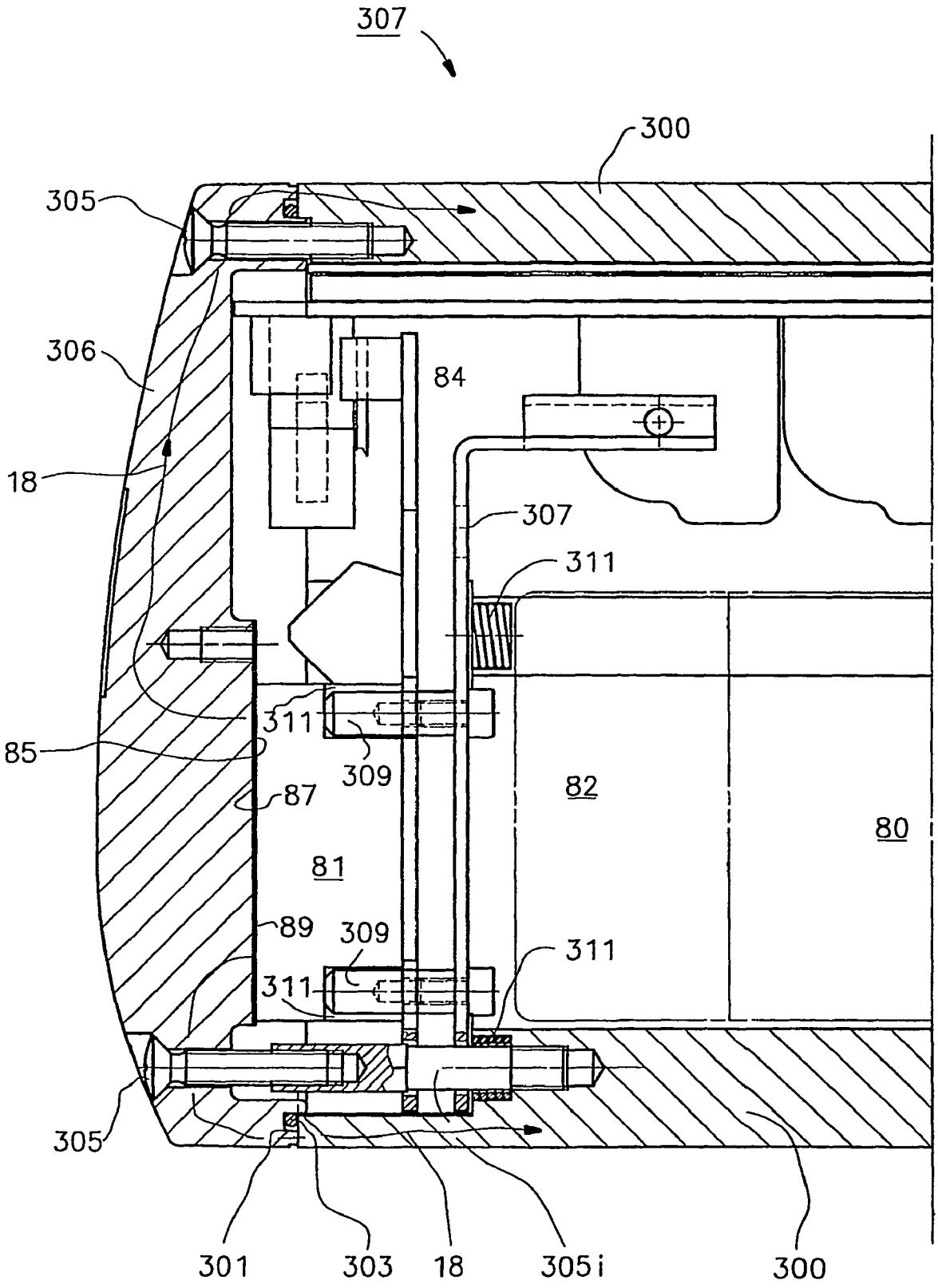
Figure 20:
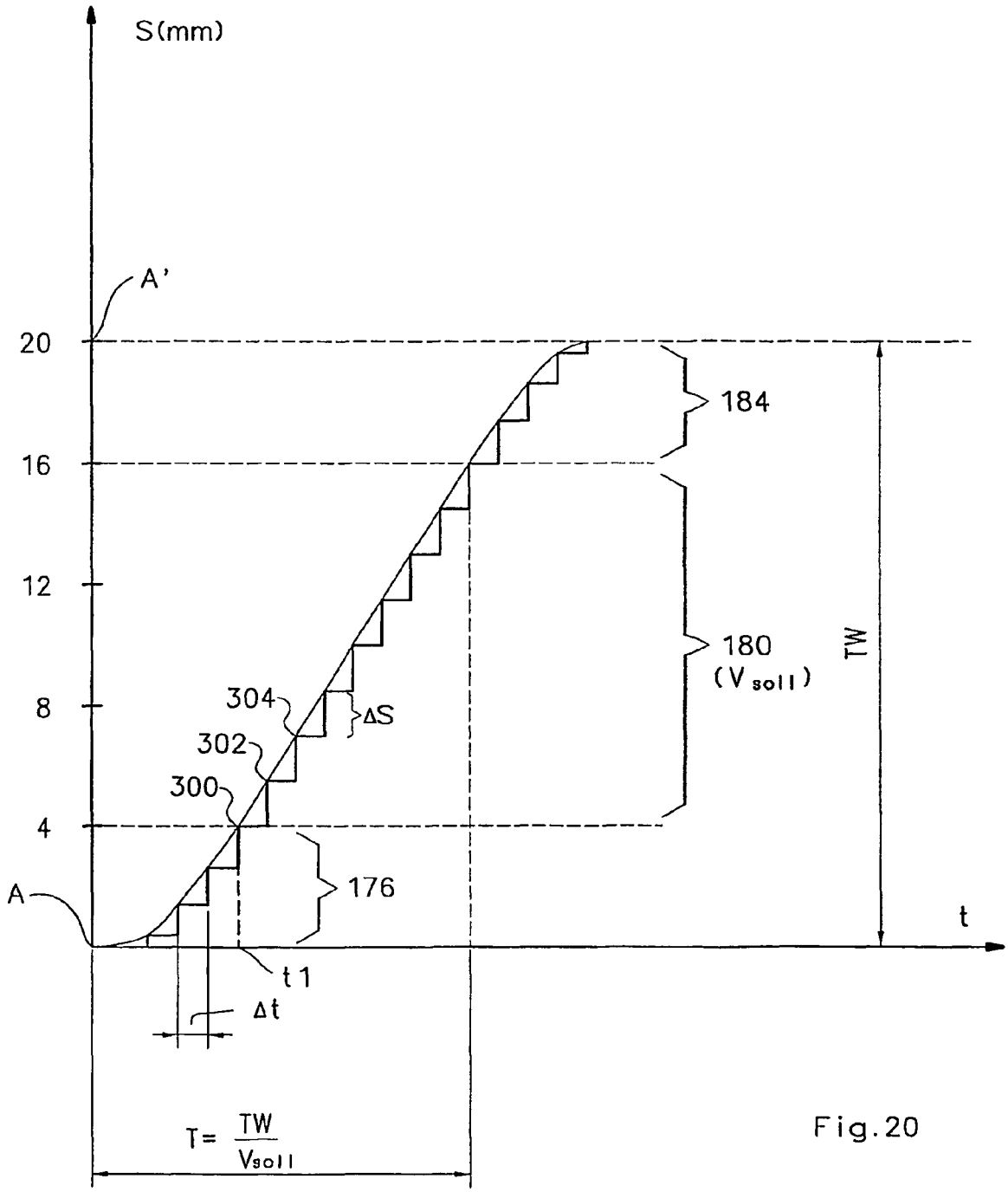

FIG. 5 schematically depicts a labeling apparatus in the state before the beginning of a-labeling operation;

FIG. 6 depicts the labeling apparatus according to FIG. 5 in the course of a labeling operation, and at the point at which a residual distance is inputted into the position controller;

FIG. 7 depicts the labeling apparatus of FIGS. 5 and 6 after completion of the labeling operation;

FIG. 8 schematically depicts the steps during dispensing of a label from a label strip, which is depicted at the bottom of FIG. 8;

FIG. 9 is a depiction analogous to FIG. 8, showing area calculation with reference to a simple example;

FIG. 10 is a depiction analogous to FIG. 9 but for a higher labeling speed, for the same label strip as in FIG. 9;

FIG. 11 is a depiction analogous to FIGS. 9 and 10 but for a lower labeling speed, once again for the same label strip as in FIGS. 9 and 10;

FIG. 12 is a flow chart of the steps during an advance of the label strip;

FIG. 13 depicts a preferred embodiment of controller 218 that is used;

FIG. 14 is a diagram of signals generated by encoder 82;

FIG. 15 is a view analogous to FIG. 13, in which the individual components of controller 218 are graphically highlighted in order to facilitate comprehension;

FIG. 16 is a view analogous to FIG. 3, except that a printer 280, with which labels 26 are imprinted before they are dispensed at dispensing edge 30, is arranged on table 42;

FIG. 17 is a section looking along line XVII-XVII of FIG. 3;

FIG. 18 is a view looking in the direction of arrow XVIII of FIG. 17;

FIG. 19 is an enlarged section through the front side of scoop 307; and FIG. 20 is a diagram to explain the functioning of a preferred embodiment of the position controller that is used.

DETAILED DESCRIPTION

Figure 1:
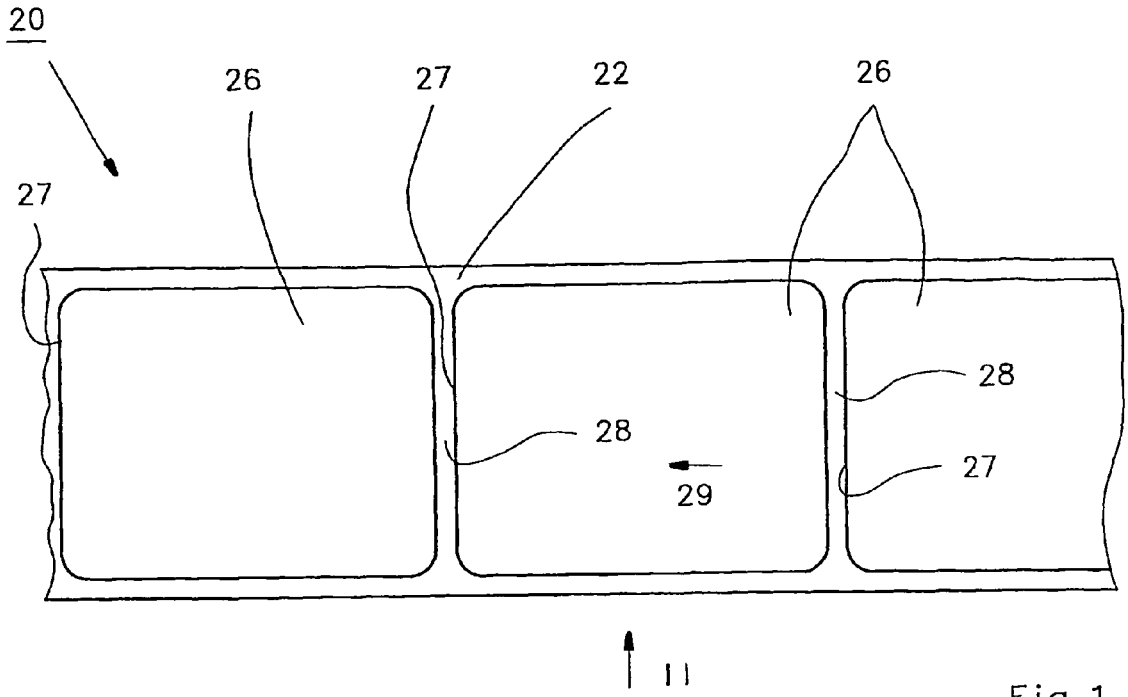
FIG. 1 is a plan view of an ordinary label strip.
Figure 2:
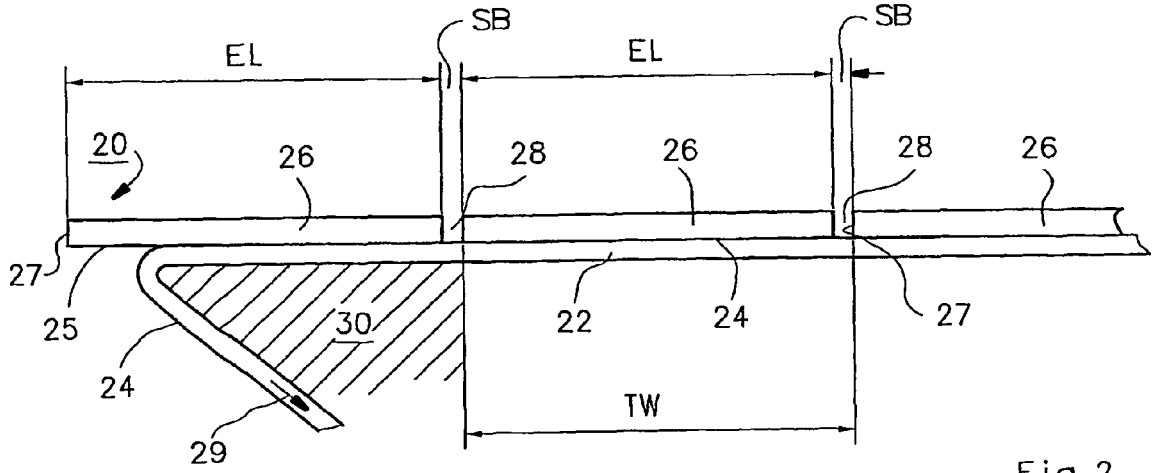
FIG. 2 is a side view of the label strip of FIG. 1, looking in the direction of arrow II of FIG. 1.

FIG. 1 is a plan view of a label strip 20, and FIG. 2 shows that strip in a side view. In the side view, the dimensions in the vertical direction are depicted in extremely exaggerated fashion to allow better comprehension of the invention.

Label strip 20 has, at the bottom in FIG. 2, a carrier strip 22, usually made of paper, that is provided on its upper side in FIG. 2 with a release layer 24, usually made of silicone. Self-adhesive labels 26 are adhesively bonded onto layer 24 by means of a contact adhesive layer 25. These labels have a label length EL that can be between a few millimeters and hundreds of millimeters. It is obvious that the labeling performance can be higher with short labels than with long labels. The direction of motion of label strip 20 is labeled 29, and the label edges that are toward the front in the direction of motion are labeled 27. Because label strip 20 and carrier strip 22 are identical except for the presence or absence of labels 26, the expression "strip 20/22" will also be used hereinafter.

Located between two adjacent labels 26 is a gap 28 that is created during manufacture by the removal of a so-called "spacer" of label material; the width of gap 28 is therefore also referred to as spacer width SB. SB usually has a value of between 1 and 10 mm. Label length EL and spacer width SB together equal transport distance TW over which label web 20 must be moved forward upon dispensing of a single label 26. The relationship is $$TW=EL+SB. \quad (1)$$

When label web 20 is pulled around a dispensing edge 30, also called a detaching edge, as shown in FIG. 2, a label 26 detaches there from carrier web 22 and can be, for example, picked up by a suction plate and transferred onto a box that is to be labeled. Alternatively, the detached label can also be applied directly onto an object P (FIG. 3) that is to be labeled, as is common knowledge to one skilled in the art.

FIG. 3 shows a preferred embodiment of a labeling apparatus 40 according to the invention. This apparatus has a table 42 having dispensing edge 30. Dispensing edge 30 can also, if applicable, be movable (cf. European Patent 0 248 375 of HERMA GmbH). Label strip 20 is pulled over this table 42 as far as labeling edge 30, in the manner depicted, and deflected there. At each working cycle, the frontmost label 26 is detached there from carrier strip 22 and, for example, picked up by a suction plate (not depicted) or also dispensed directly, "on the fly," onto an object P that is to be labeled as it passes by. (The suction plate serves to transfer the picked-up label onto a stationary object, e.g. onto a can, carton, or the like.)

Located on table 42 is a label sensor 44 whose function is to generate a signal when, for example, a front edge 27 (FIG. 2) of a label 26 passes sensor 44 during the motion of label strip 20; that signal triggers an interrupt whose function will be described below with reference to FIG. 12. The sensor can be of any suitable kind, e.g. an optical sensor or an electrically or mechanically operating sensor, as is known to one skilled in the art.

A labeling unit 46 is mounted on table 42. Located in that unit is a computer 116 (FIG. 4), described below, for controlling the labeling operation, as well as an electronically commutated internal-rotor motor 80 (FIG. 4) having a very low axial moment of inertia, the entire power supply, EMC filters, and the commutation electronics, as described in detail below. Labeling unit 46 can be connected directly to the power grid via a power cable 48, and requires no further electrical cabinets or the like, thereby greatly simplifying installation and use.

A supply spool 52 having a label strip 20 is rotatably articulated on device 46 via a support arm 50 indicated with dashed lines. The strip is guided from supply spool 52 over a deflection roller 54 and a swing arm 56. The latter has a guide surface 58 with a slight curvature, and has the function of absorbing shocks in label strip 20, which are unavoidable because of the high strip speeds (more than 100 m/min) that can be reached. These shocks, and the elastic properties of carrier strip 22, make control operations difficult because they are transient phenomena.

In particular with fast-running labeling devices or large, wide label spools, unwinding spool 52 can also be driven by an electric motor (not shown) whose rotation speed is controlled by the position of swing arm 56. This facilitates the control process.

For even faster labeling devices or greater demands in terms of labeling accuracy, a loop can also be provided between supply spool 52 and a strip brake 60; at that loop the label strip is held to a predetermined length, for example by a vacuum and by means of an optical loop scan, so that it is conveyed to strip brake 60 with a constant tensile stress. This solution is suitable in particular for strip speeds greater than 80 m/min. Corresponding "loop pre-rollers" are offered by HERMA GmbH.

From swing arm 56, 58, label strip 20 runs to a strip brake 60 whose function is to keep strip 20 constantly in a tensioned state between that brake 60 and detaching edge 30, and as far as transport roller 62. Strip brake 60 acts in general as a damping system for the control system that is used. From brake 60, label strip 20 runs over table 42 to detaching edge 30 where labels 26 are successively individually detached during operation, and carrier strip 22 (without labels 26) runs under table 42 to a transport roller 62 that is driven by motor 80 via gears 83 (FIG. 17). Carrier strip 22 is pressed by a pressure roller 64 against transport roller 62 in order to transfer all the motions of transport roller 62 to carrier strip 22.

From transport roller 62, carrier strip 22 runs to a swing lever 66 that serves to compensate for shocks in carrier strip 22; and from swing lever 66 it runs on to a carrier strip take-up spool 68 that in turn is mounted via a carrier arm 70 on device 46, and forms one compact unit with the latter. Take-up spool 68 can be driven by a separate motor that is not depicted.

A product detection sensor 72, which is connected via a line 74 to device 46 and supplies a start pulse when a product P moves past that sensor 72, serves to sense a product that is to be labeled. That start pulse then triggers a labeling operation, as is known to one skilled in the art.

Figure 4:
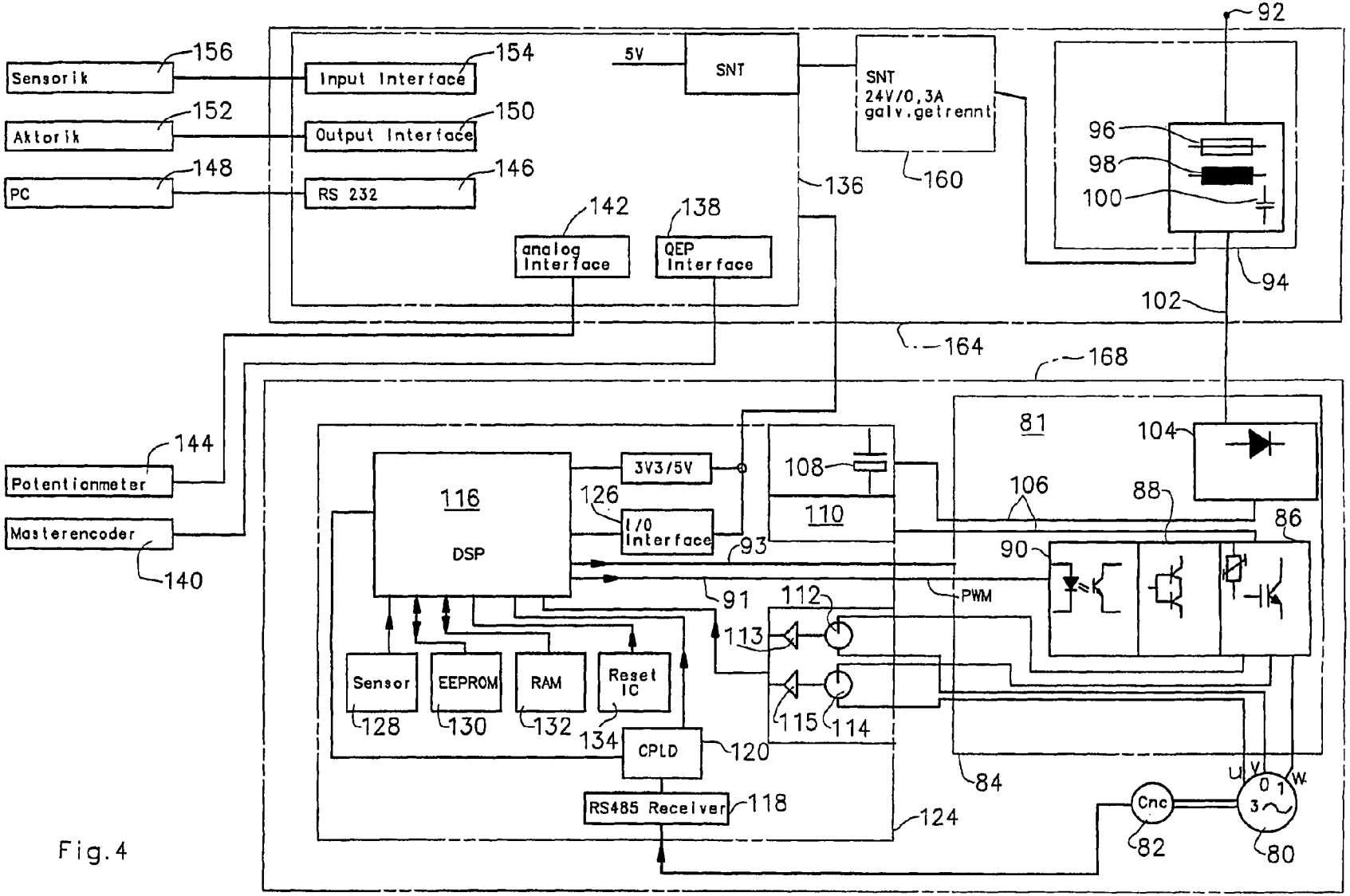
FIG. 4 is a synoptic block diagram of a labeling device according to the invention.

FIG. 4 shows a preferred exemplifying embodiment of the construction principle of the electrical portion of labeling device 46. This uses a three-phase electronically commutated internal-rotor motor 80 that is coupled to an encoder 82 for the generation of position signals. From these position signals, for example, 10,000 pulses per revolution can be derived. Motor 80 drives roller 62 of FIG. 3 via gears 83 that are depicted in FIGS. 17 and 18. In the exemplifying embodiment, one revolution of motor 80 corresponds to the transport of strip 22 over a distance of approximately 50 mm.

Motor 80 has a commutation controller 84, here having an IGBT* output stage 86 that is also depicted in FIG. 19, and also having driver stages 88 and an activation system via optocouplers 90 in order to achieve galvanic separation from the low-voltage section. This is necessary because motor 80 preferably operates with a relatively high operating voltage (rectified voltage from the local alternating-current or three-phase power grid). Commutation at startup is controlled in the usual way via Hall sensors (not depicted) that are built into encoder 82. A PWM signal is delivered in known fashion, via a line 91, to commutation controller 84, in particular for current limiting.

Motor 80 is supplied with energy from an alternating-current or three-phase power grid 92. To eliminate EMC interference, this takes place via a power grid filtering and distribution circuit board 94. The latter has, as usual, fuses 96, chokes (inductances) 98, and capacitors 100. Connected to output 102 of board 94 via a rectifier arrangement 104 is a DC link circuit 106 that has smoothing capacitors 108 and a short-circuit detector 110 associated with it. DC link circuit 106 energizes motor 80 via output stage 86 [Translator's Note: *Insulated Gate Bipolar Transistor] (in the form of a three-phase full bridge that is often also referred to as a "PWM inverter"). The voltage at the motor depends on the voltage in grid 92, which can be, for example, between 85 and 265 V as alternating current, or from 120 to 375 V in a DC range. The voltage at motor 80 is further dependent on a PWM signal that is generated by a DSP 116 and delivered via a line 91.

The current in two of the three phases of motor 80 is sensed via current transformers 112, 114, amplified to a desired level via two operational amplifiers 113, 115, and delivered to arrangement 116 for digital signal processing, preferably to a 16-bit digital signal processor (DSP), for example of the 2407 type, in which a motor regulation system and a single-axis positioning system are integrated. Because of its high processing speed of, for example, 40 MIPS, this DSP 116 enables a particularly high labeling accuracy at a high labeling speed in the context of the invention, but other processors are of course also usable in the context of the invention.

The output pulses of encoder 82 are also delivered to DSP 116 via an RS 485 module 118 and a CPLD element 120, thereby making possible regulation of position and rotation speed. The CPLD (Complex Programmable Logic Device) element 120 serves here to decode the serial signals from encoder 82. The two current transformers 112, 114 also make possible current regulation and current limiting, enabling a startup of motor 80 with a starting ramp of predetermined slope $\Delta 1$, as well as a braking operation with a predetermined ramp slope $\Delta 2$, i.e. a predetermined braking torque. Via a symbolically depicted busbar connection (bus) 93, DSP 116 supplies the signals for commutation controller 84, as well as PWM signals to line 91.

DSP 116 is located on its own circuit board 124, on which are also located an I/O interface 126, a sensor 128 for temperature sensing on circuit board 124, an EEPROM 130 for storing a (modifiable, if applicable) program, a RAM 132 as buffer memory for calculation operations, and a reset IC 134. The latter serves to deliver a defined signal level to the reset input of DSP 116 when the voltage supply is switched on and off, thereby ensuring reliable booting and shutdown of DSP 116.

Also provided is a communication module 136 that serves to connect DSP 116 to the outside world. This module is connected to DSP 116 via I/O interface 126. It has a QEP interface 138 for connection to an external master encoder 140 that, for example when bottles are being labeled, simultaneously controls both the motion of the bottles and the operation of labeling device 46 synchronously therewith.

When a master encoder 140 is used to synchronize the speed of products P with the speed of labels 26, a fixed value from the potentiometer is not used, but instead the speed is specified by this encoder.

Start sensor 72 has a dead time that results in different positionings of labels 26 in the context of a modified speed of product P. To prevent this, a startup compensation for this dead time, in the form of a distance, is calculated on the basis of an inputted dead time and the present speed of products P. This functions even when multiple start signals are present and must be processed successively because of a long start delay. A corresponding compensation is then calculated for each of these start signals, so that labels 26 are always applied onto products P at the same location.

Master encoder 140 preferably uses two traces A and B that are delivered to profile generator 220 as input variables. From the sequence of these pulses, a signal for the rotation direction of motor 80 can be calculated in known fashion. A "gear ratio" parameter, which can be positive or negative, is also generated. From the frequency of the pulses, the information as to the rotation direction, and the "gear ratio" parameter, a reference variable for positional regulation is generated; that variable usually is not constant but changes during operation.

The reference variable can be positive or negative, for the following reason: there are labeling devices in which table 42 projects to the left as depicted in FIG. 3, so that label strip 20 must be transported to the left. There are also, however, labeling devices in which table 42 projects to the right, and label strip 20 must consequently be transported to the right. This is indicated by the sign (+ or −) of the reference variable.

If the sign of the reference variable is "wrong" for the selected version, i.e. does not correspond to it, the pulses coming in from product detection sensor 72 are blocked in order to prevent label strip 20 from being driven in the wrong direction.

Because encoder 140 uses two traces A and B, a speed of V=0 m/min during a labeling cycle is also possible, i.e. when a label 26 has already been partly stuck on. In this case, the true position remains practically unchanged by the decrementing or incrementing of a position counter, and a "drift" in the backward direction is prevented. Such drift could cause carrier strip 22 to lose its tension.

Module 136 furthermore has an analog interface 142 to which can be connected potentiometers 144, 145, 147 with which the user can set or fine-tune the labeling speed, the residual distance (follow-on distance) S2 (FIGS. 5 to 7), and a start delay. These potentiometers are shown in FIGS. 3 and 16.

Module 136 furthermore has a serial RS 232 interface 146 for connection to a PC 148, an output interface 150 for connecting to actuation elements (in particular pneumatic cylinders) 152, and an input interface 154 for connecting to sensor elements 156, e.g. in order to specify the direction, sense the temperature, or the like. Lastly, a serial digital connection (not shown) to other devices of identical or similar construction can also be provided, if desired.

A module 160 serves to supply power to the electronics.

The components enclosed within a dot-dash line 164 constitute the connection from motor 80 to the outside. The components enclosed within a dot-dash line 168 represent the actual drive system plus control system. Further peripheral units, e.g. a keyboard or a display, can be connected to component 136 if applicable, so that desired functions can be adjusted manually.

Motor 80 is operated using a four-quadrant controller, since it must be actively braked during a labeling operation, although the capability for running backward, which is inherent in a four-quadrant controller, is suppressed because backward running must not occur in a labeling drive system (since it would eliminate the tension in the label strip and considerably disrupt control operations).

FIGS. 3, 17, and 19 show that motor 80 is arranged in a tubular component 300 that is mounted on a housing wall 302 by means of screws 304 that also serve to mount motor 80. Component 300 is preferably an extruded aluminum profile, and is closed off on its left side (in FIG. 19) by a solid cover 306 made of metal, e.g. aluminum, that is mounted on part 300 by means of screws 305 (FIG. 19). Cover 306 is a cast part, and serves as a heat sink and cooling element for a power module 81 that contains output stage 86 and link circuit rectifier 104. FIG. 19 shows further details. Component 300 dissipates its heat in part to housing wall 302, which likewise represents part of the (passive) cooling system. Motor 80, in which a great deal of heat is generated because of the high peak currents, also dissipates that heat to part 300 and to housing wall 302. The use of an active cooling system is, of course, not excluded.

Part 300 and its cover 306 together form a kind of cover cap 307, also referred to as a "scoop," that receives motor 80 and a substantial portion of its electronics. Scoop 307 acts not only as a dust-tight sealed container for these parts, but also as a cooling element; this makes possible an extremely compact design, since external electrical cabinets can in most cases be omitted. This also simplifies installation, since it is necessary only to set up device 46 and connect it to grid 92. It also simplifies explosion protection and protection against moisture, e.g. washing fluid from high-pressure washers.

This design is advantageous because it is thereby possible to encapsulate the entire labeling device 46 in liquid-tight fashion, for example so that it can be cleaned with a high-pressure washer. For industries in which an explosion hazard exists, e.g. in refineries in hot countries, such devices are preferably implemented in dust-tight fashion in order to reduce the explosion hazard, and the invention makes this very simple.

FIGS. 5 to 7 show, in a highly schematic depiction, operations during the dispensing of a label **26*v* onto a suction device 170** that, in this variant, serves to transfer the dispensed label, after dispensing, onto a stationary product P, e.g. onto a box, a package, or the like.

FIGS. 5, 6, and 7 schematically show the same dispensing edge 30 and the same label sensor 44. During dispensing of a label 26, label strip 20 is pulled in the direction of arrow 29 by drive roller 62 driven by motor 80. Because one complete revolution of drive roller 62 transports carrier strip 22, for example, 50 mm forward, and because transport distance TW for one dispensing operation is often on the order of from 10 to 200 mm, the operations described usually occur in a range from one to two revolutions of drive roller 62, which is connected via gears 83 to the shaft of motor 80, i.e. roller 62 is first accelerated in accordance with a predetermined speed profile, then proceeds for a while, e.g. for half a revolution, at an approximately constant speed, and is then braked to zero in accordance with a predetermined profile. These operations can repeat, for example, thirty times within one second, if thirty labels are dispensed within that second. These operations must proceed extremely precisely, since the dispensed labels 26 must be placed precisely at the desired locations with tolerances that are often on the order of 0.1 mm.

In FIG. 5, label strip 20 is at rest on table 42. Located on the latter is a front label **26*v* and a rear label 26*h*. Label sensor 44 is located on label 26*v* at a location A that is at a spacing S2 from front edge 27 of label 26*v*. After the dispensing of label 26*v*, label 26*h* must be located under label sensor 44 (cf. FIG. 7), the latter resting on label 26*h* at a location A' that is likewise at a spacing S2 from front edge 27 of label 26*h*. Location A' should therefore correspond as exactly as possible to location A, as one skilled in the art will immediately understand. The spacing between A and A' corresponds in FIG. 5 to transport distance TW, and the latter corresponds (assuming correct transport) to one label length EL+one label spacing SB, as indicated in equation (1); it also corresponds to the sum of two distances S1 and S2 as depicted in FIG. 5, S1 being the spacing from location A to front edge 27 of rear label 26*h*, and S2 the spacing from front edge 27** to location A'.

As shown in FIG. 6, after a start instruction, label strip 20 is transported in the direction of arrow 29, front label **26*v*** being advanced with its upper and (in most cases) non-adhesive side 26*u* onto suction device 170 and being picked up by it.

Front edge 27 of rear label 26*h* thereby arrives (cf. FIG. 6) at label sensor 44, and by it triggers an interrupt in DSP 116. In this example, that interrupt therefore exactly defines a specific position of front edge 27; and if the intention is to control the motion sequence so that motor 80 is brought to a stop exactly when label 26*h* has reached label sensor 44 at its location A1 (cf. FIG. 7), the same spacing S2 must then exist between front edge 27 and that location A' after each labeling operation, as indicated in FIG. 7.

A new target datum S2 is therefore loaded into computer 116 when the position in FIG. 6 is passed through. This new target datum is more accurate than the target datum TW inputted at the position shown in FIG. 5, since TW is continuously subject to small fluctuations that would cause locations A, A', etc. to "wander" to different locations on labels 26 over time, i.e. the label would be offset.

It should be noted in particular that although measurement at label edge 27 offers specific advantages, other types of measurement are nevertheless possible in many cases. For imprinted labels, for example, an optical mark can be provided at a specific location on the label, which mark is scanned during operation and then results in the above-described interrupt whereupon the value S2 is loaded; or a hole can be punched in label strip 20 and an interrupt can be triggered at that hole, etc.

Another advantage is that distance S2 can be varied by the user. This value very accurately stipulates the position of points A, A' on labels 26, i.e. that position can be modified as desired by modifying S2, thereby automatically modifying the position of the dispensed labels.

After the installation of a new label strip 20, the procedure in practice is as follows:

Labels 26 are manually pulled off carrier strip 22 over a length of about 1 m, and the strip is inserted into the labeling device. The label type is usually inputted beforehand into the labeling device; data for that type are stored (or can be stored) in a format memory of the labeling device in order to enable easy switchover to different labels. The following are stored, sorted according to product groups: speed Vsoll, follow-on distance (residual distance) S2soll, and start delay, as well as the gear ratio (electronic gearbox) when master encoder 140 is used for speed sensing.

Once the strip is inserted, an instruction is given manually for motor 80 to run; it continues to run until the first label 26 arrives at sensor 44, and is braked to zero after having traveled distance S2.

Because in this case there is still no label 26 at dispensing edge 30, this operation is repeated by corresponding manual instructions until a label 26 is present at dispensing edge 30. Label length EL and label spacing SB are accurately ascertained in this context, i.e. the new label strip is "surveyed" by DSP 116.

From now on labeling can occur, since the data regarding label length, etc. are stored. Label length EL and label spacing SB are preferably also continuously ascertained during operation, and automatically corrected as necessary.

A button 99 (FIGS. 3 and 16), referred to as the "predispensing" button, is provided on the labeling device for manual control of these operations.

If a different label size, for example a longer label, is used, a new distance S2 is then also automatically specified, and that distance can additionally be varied somewhat by the user. This makes it possible to install label sensor 44 at a specific location on table 42 and, when a label strip having different labels is inserted, to readjust the machine by merely setting the length S2, i.e. an electrical variable. It is therefore often unnecessary to adjust label sensor 44 mechanically when different types of labels need to be used.

Because the value TW is inputted accurately based on the values stored in the device, the labeling device can continue to operate even if one label 26 happens to be missing from label strip 20, since although no interrupt is then generated by sensor 44, the computer is nevertheless working in this case with the variable TW, so that label strip 20 is brought to a stop at least in the vicinity of positions A, A'. This is important because individual labels may occasionally be missing from a label strip because of production errors. Splices in the label strip can also result in measurement errors. At a splice, a second strip is adhesively bonded onto a first strip by means of a self-adhesive tape, and the presence of that self-adhesive tape increases the thickness of the label assemblage and can therefore lead to incorrect measurements.

If, for example, the spacing between the front edges of two labels is 42 mm, it must be ensured that even at an attachment point where two strips are joined to one another, the label strip is halted every 42 mm, so that all the labels are correctly imprinted in a printer, and none of the objects to be labeled leaves the labeling facility without an imprinted label.

If it were possible for the label strip simply to keep running at a splice, and to come to a halt again, for example, only after 84 mm, a label would then not be imprinted, but it would not be possible to prevent that unimprinted label from then being used for labeling. The invention is therefore highly advantageous especially when a printer is used, since it prevents objects from being labeled with unimprinted labels.

FIG. 8 explains the invention with reference to a diagram in which, for simplification and as an aid to comprehension, label strip is depicted notionally 20 as stationary and label sensor 44 as moving in the direction of an arrow 29' from the left (i.e. a start position A) to the right, to a measurement position M and then to a target position A'. In this exemplifying embodiment the measurement position M preferably corresponds to front edge 27 of label 26*h*; other variants are also possible, as already explained.

The depiction in FIG. 8 is a specific depiction for motion sequences, and deviates greatly from the ordinary.

As depicted in the upper part of FIG. 8, the horizontal axis therein shows time t, and the vertical axis shows the speed V of label strip 20, i.e. V=dS/dt.

The lower part of FIG. 8 shows motion, but not on a linear scale. At locations A and A', for example, the speed V is equal to 0.

A calculation of $$S=\int V\,dt \qquad (2),$$

i.e. the integral of the speed over time, yields the distance S that has been traveled. In FIG. 8, for example, the area under curve 180, 184 between locations M and A' is graphically highlighted, and this area corresponds to the distance S2 traveled between times M and A'. This area must not change when the labeler is operated at different speeds, provided the same label is being processed.

Locations A, M, and A' thus on the one hand represent specific points that sensor 44 reaches during its (imaginary) motion from left to right; and on the other hand they represent, on the time axis, the points in time at which sensor 44 reaches these locations A, M, and A' during its "motion."

The graphically highlighted area between points M and A' is made up of a variety of sub-areas, as follows:

An area 179 is the component of the distance S2soll that is adjustable by the operator of the device. The operator can modify only this portion.

An adjacent area 181 represents a reserve in case the labeling speed is increased (cf. FIG. 10).

Adjacent to area 181 on the right is an area 185. To the right of area 185, area F184 lies under ramp 184. The area under ramp 176 is labeled F176.

According to equation (2), the distance S2soll corresponds to the area graphically highlighted in FIG. 8, i.e. the sum of areas 179, 181, 185, and F184; and in the event of a change in the speed Vsoll, the boundaries of these areas must be redefined by DSP 116 in such a way that their sum remains constant.

A distinction must be made in general between

A) the profile S=f(t), i.e. the profile of the position setpoint plotted against the time axis; and B) the profile V=f(t), i.e. the profile of the speed of label strip 20 plotted against the time axis.

The profile S=f(t) is specified to position controller 273 in the form of small steps, e.g. every 100 μs. One instruction might be, for example: "At the end of the next 100 μs, the label strip must have reached the 13.2-mm position." In the context of the interrupt at measurement location M, target position Z (which represents a variable) is corrected in profile generator 220, so that position controller 273 then correspondingly receives corrected values, as already described in detail.

The profile V=f(t) is used to generate a labeling cycle as shown in FIG. 8. Ramps 176, 184 are preferably embodied in principle with an acceleration $$b=V/t[m/s^2] \quad (3),$$

i.e. their slope preferably remains substantially independent of the labeling speed. The way in which this is preferably done is described below with reference to FIG. 20.

In start position A, as shown by curve portion 176 (first motion phase), the increase in speed V begins with a predetermined slope Δ1, i.e. in accordance with how the travel curve is stored in profile generator PG 220 (FIG. 13). In one exemplifying embodiment, for example, an increase in the motor rotation speed to 3000 rpm required a rotation angle of approx. 66°, corresponding to a motion of approx. 8 mm of strip 20/22.

In curve segment 176, the speed V increases until a speed Vsoll is reached that can be specified by the user via an adjusting element, as symbolized by an arrow 178. The speed Vsoll determines the working speed of the labeler. It can be, for example, between 80 and 160 m/min. A value of 120 m/min corresponds to 2 m/s, and approximately 10 to 30 labeling operations can then take place every second.

When the speed Vsoll has been reached, the labeling apparatus transitions into an operating mode at a substantially constant speed (curve 180=second phase of the motion profile), running through travel distance S1 beginning at start position A. Before startup, profile generator 220 was set to a target position Z=EL+SB, i.e. to a profile in which an overall travel distance TW is traversed, that distance TW corresponding to the total area under curve 176, 180, 184.

After passing through distance S1 (measured by means of the output signals of encoder 82), label sensor 44 arrives at measurement position M, i.e. at front edge 27 of label 26*h*; and passage over this front edge 27 causes a measurement interrupt at location/time M. At this location, processor DSP 116 has reached a counter status $S1_{IST}$ corresponding to the actual distance S1 that has been traveled.

The value S2soll predetermined by the user, which can also be referred to as the residual distance or follow-on distance, is then added to that counter status $S1_{IST}$. The value $$Z=S1ist+S2soll \quad (4)$$

is then used as a new target value Z (setpoint for the distance to location A').

In accordance with variable S2soll and in accordance with the magnitude of speed Vsoll, DSP 116 now calculates a point in time 182 at which, according to the slope Δ2 of ramp 184, active braking of motor 80 must begin so that by time 182, motor 80 is running at speed Vsoll and transitions there into the decreasing ramp 184 (third phase of the speed profile), in which motor 80 is braked by position controller 218 in such a way that at location A' it reaches the value V=0, i.e. label strip 20 is at a standstill.

The predictive calculation of times 182, 182' for the transition between phases 2 and 3 of the speed profile is performed in DSP 116 and is explained below, using examples, with reference to FIGS. 9 to 11.

The values to which the user can set the variable S2soll are limited by the program by the fact that the change in area 179 is limited in the manner described above. It should be noted that as speed V increases, the time interval between times A and A' decreases, the integral defined by equation (2) (from A to A') being kept constant by DSP 116.

With the method according to FIG. 8, target position Z is therefore redefined, while the motor is running, during the interrupt at measurement location M (front edge 27 of label 26*h*). This method decisively enhances labeling accuracy in practical use. This is because the result of this method is that spacing S2 between point A and front edge 27 of front label 26*v* very largely corresponds to spacing S2soll between point A' and front edge 27 of rear label 26*h*, i.e. points A, A' do not "wander," but retain the spacing S2, set by the user, from front edge 27 of the respective label 26. This "correction" allows the interference factors that occur during operation of the labeling device to be largely compensated for. These factors are principally:

a) The variable forces that act from outside on the strip, i.e. label strip 20 and carrier strip 22, principally as a result of the resilient swing arms 56 and 66 (FIG. 3).

b) The effects resulting from the fact that strip 20/22 elongates as it is accelerated during the rising phase 176, also referred to as the "rubber band effect" in such label strips.

c) Small fluctuations in label length EL and label spacing SB—so-called "pitch errors"—also have no influence, provided the measurement is made as close as possible to dispensing edge 30, for which reason an effort is made to arrange sensor 44 as close as possible to dispensing edge 30.

FIGS. 9 to 11 serve to explain the automatic adaptation of the profile, by means of profile generator 220, when setpoint speed Vsoll needs to be modified.

FIG. 9 is a depiction analogous to FIG. 8. If angles Al and A2 have the same absolute value, i.e. if rising flank 176 has a slope of the same absolute value as falling flank 184, area F184 (under flank 184) is added to area F146 (under flank 146) to yield a rectangle as symbolically depicted by an arrow 183; what is obtained overall in this simplified example, together with rectangular area F180 (under portion 180), is a rectangle having a height Vsoll and a length T, length T being the time between leaving point A and reaching point 182, the value of which is labeled 182' on the time axis.

This area corresponds to the dimension TW of FIG. 2, i.e. the spacing between front edges 27 of two successive labels 26.

When speed Vsoll is modified, this area TW must not change. In this simplified example, therefore:

$$TW=Vsoll*T \quad (5).$$

The consequence is that if label spacing TW and speed Vsoll are known, the variable T can be directly calculated as $$T=TW/Vsoll \quad (6).$$

What is known in this example is therefore the following: After startup at location A, speed V increases with a slope Δ1 until speed Vsoll has been reached.

Once Vsoll has been reached, label strip 20 is driven at a constant speed Vsoll until, at time A, the time interval T=TW/Vsoll has elapsed, i.e. time 182' has been reached.

At time 182', the drive system is switched over to braking with a slope Δ2, and at time A', position A' on rear label **26*h* is reached in position-controlled fashion (FIG. 8**) independently of the speed Vsoll that is set, i.e. labeling always occurs correctly regardless of whether the machine is running fast or slowly.

In FIG. 10, the drive system is set to a maximum speed Vmax, i.e. rising flank 176 and falling flank 184 are longer than in FIG. 9. The gray-shaded area TW must correspond to area TW shown in FIG. 9, and consequently time T here is correspondingly shorter, i.e. T=TW/Vmax.

Here as well, time T since startup at location A is measured, and if that time has elapsed upon reaching location 182', the system switches over to braking, e.g. with a slope Δ2.

FIG. 11 shows the analogous case in which the drive system is set to the minimum speed Vmin. Here as well, the gray-shaded area TW must correspond to the size of the corresponding areas TW in FIGS. 9 and 10, and the result is a correspondingly long time $$T=TW/Vmin$$

between leaving location A and reaching time 182'; at this point the system switches over to the falling flank 182, so that here again, labeling is performed correctly.

Profile generator 220 thus contains the following variables:
Label spacing TW, expressed as target magnitude Z.
Slope Δ1 of rising flank 176.
Slope Δ2 of falling (braking) flank 184.
Speed Vsoll.

On the basis of these variables, profile generator 220 calculates the profile that corresponds to speed Vsoll that has been set, variable T being calculated predictively in the manner described.

T is particularly easy to calculate if slopes Δ1 and Δ2 are made equal in terms of absolute value, but these slopes can, of course, also be different. In that case areas F146, F180, and F184 must be calculated or estimated separately, and the applicable equation is then $$TW=F146+F180+F184 \quad (7).$$

The rotation speed profile that must be generated by motor 80 is therefore calculated from the data delivered to DSP 116; for a specific label type, spacing TW defines the size of the area under the profile 176, 180, 184, and that area, regardless of the speed Vsoll that is instantaneously set, is kept substantially constant by automatic recalculation of the speed profile V=f(t).

It should be noted that variable T is usually equal to only a fraction of a second, since, for example, thirty labeling operations occur every second. This depends on the speed Vsoll that is set, since of course fewer labels are processed per second at a lower speed.

The fact that target variable Z is corrected at location M results automatically in an adaptation if spacing TW changes in a label strip, as has already been described in detail. This then also results in a correction of time T, as is clearly apparent to one skilled in the art from the description above, i.e. if target variable Z changes, time 182' is preferably also recalculated.

It is very important, especially for the labeling of objects P as they pass by (cf. FIG. 3), that within a predetermined period of time, a label 26 that is to be dispensed reach the same speed as that object P, so that the label is "stuck" onto that object at the correct location; the label must also be dispensed at exactly the speed of the product passing by, i.e. good synchronization between product P and label 26 must be ensured. This requires that the motion of label strip 20 obey corresponding instructions very exactly, i.e. that position controller 273 be able to control the motions of label strip 20 very effectively.

FIG. 12 is a flow chart for execution of the CORR.Z (target correction) routine S200 that controls the rotation speed profile of motor 80.

S202 checks whether a start signal from sensor 72 (FIG. 3) is present. If No (N), the routine enters a loop back to the beginning. If Yes (Y), the routine goes to step S204. There profile generator 220 (FIG. 10) is loaded in accordance with the predetermined parameters, e.g. the value Z:=TW and the desired speed Vsoll. The values generated by profile generator 220 are based on stored value tables, and the profile generator calculates the motion profile therefrom. The profile is a rotation speed profile and begins at V=0 and ends at V=0, as depicted in FIG. 8. The value Z in S204 corresponds to the sum (EL +SB) for label strip 20 being used. (It is also possible, if applicable, to work with multiples of (EL+SB) if no printer is provided on labeler 46.)

S206 then checks whether measurement position M has been reached, i.e. whether label sensor 44 has generated, at front edge 27 of label **26*h*, a signal that triggers an interrupt in the manner already described, in order to enable an immediate reaction to this event caused by rear label 26*h***.

If measurement position M has been reached (response =Y), profile generator 220 is corrected in S208 in the manner already described, and the measured distance S1ist, measured up to where measurement position M was reached, has the desired residual distance S2soll added to it in accordance with equation (4); the result Z=S1ist +S2soll is used as a new target variable Z, i.e. replaces target variable Z from S204, so that profile generator 220 regulates the operation of motor 80 according to the new target variable Z, i.e. the profile generator is correspondingly corrected, if applicable, as indicated in S208. (Ideally, the target variables Z from steps S204 and S208 are entirely identical, but small differences are unavoidable in practice. If the values are identical, profile generator S220 of course need not be corrected.)

The program then goes to S210, where it checks whether target position Z has been reached. In FIG. 8, this target position corresponds to location A' on label **26*h*, i.e. label sensor 44 is then located exactly opposite this previously calculated location A' and motor 80 stands still, i.e. V=0. If this is the case (Y), routine S200** goes back to the beginning and waits for the next start signal.

If the response in S210 is No (N), the routine goes back to step S206.

If the response in S206 is continuously No, for example because a label 26 is missing from carrier strip 22 and label sensor 44 consequently cannot find a measurement location M and cannot trigger an interrupt, the correction of value Z in step S208 does not take place and the routine goes from S206 directly to S210, i.e. it continues to work with target variable Z from S204 and, here as well, checks in S210 whether Z has been reached. If No, the routine once again goes back to S206. If Yes, it goes back to S202 and waits there for a new start signal.

If a label 26 is missing from carrier strip 22, label strip 20 is therefore nevertheless halted approximately at location A', provided target value Z has been defined in S204 as the sum (EL+SB) according to equation (1). This is important especially when the individual labels 26 are being printed in the labeling device, as depicted in FIG. 16, since in many cases carrier strip 22 must be stationary for printing. If a label is missing, in that case the stationary carrier strip 22 is imprinted.

Depending on the application, routine S200 can contain plausibility checks, for example as described for the value S2soll.

FIG. 13 shows the associated control arrangement 218. The number 220 designates profile generator PG that, after the input of data 222 (start instruction, slopes Δ1, Δ2, TW, Vsoll, etc.) generates a speed profile as depicted and explained, for example, in FIG. 8. PG 220 thus has delivered to it a target position Z which can correspond at startup to value TW according to equation (1) or also, if applicable, to a multiple of TW if no printer 280 (FIG. 16) is provided.

PG 220 generates at its output 221 a setpoint distance Ssoll that is delivered via a setpoint/true value comparator 224 to a PI position controller S-CTL 226. What is delivered to comparator 224 as the present variable is the distance Sist actually traveled by label strip 20, which distance is obtained by counting, in a counter 228, pulses 83 supplied by encoder 82. (Counter 228 can be located in DSP 116.) The value Sist is also delivered to a calculation element 230.

FIG. 13 shows that in this example, encoder 82 has a total of six outputs, labeled A, A/, B, B/, X and X/. These are connected to a logical switching element 227, where their signals are evaluated and processed into logic signals A1, B1, and X1 that in turn are delivered to a converter 229 which generates therefrom, at an output 231, a rotational position signal Ωist that indicates the rotational position of motor 80. This signal is required for the generation of a space vector.

The information from three Hall sensors is transferred on the X channel as a serial signal that indicates the instantaneous position of the permanent-magnet rotor in motor 80 even when it is stationary.

In the exemplifying embodiment, motor 80 runs during operation as a so-called sine-wave motor, i.e. as a three-phase motor having sinusoidal stator currents. These sinusoidal currents cannot yet be generated immediately after switching on, however, since they require a very exact sensing of the rotor position, which is not possible at a standstill.

Approximate information as to rotor position is available via the X channel, however, so that motor 80 can start in an operating mode as a brushless motor 80, for which approximate rotor-position information is sufficient.

As soon as motor 80 is rotating sufficiently fast, it is switched over to operation as a sine-wave motor, since the rotor position can then be measured with very fine resolution.

Signals A1 and B1 are delivered to a QEP unit 233 that is integrated into DSP 116. This unit increases the resolution of encoder 82 by a factor of four, i.e. if encoder 82 supplies, for example, 2,500 pulses per revolution, 10,000 pulses per revolution are then obtained at the output of QEP unit 233. Higher resolution, and therefore higher system accuracy, is thus obtained. In many cases, of course, a lower accuracy will also be sufficient. A rotation speed signal nist, in the form of pulses 83 whose frequency is proportional to the instantaneous rotation speed of motor 80, is therefore obtained at the output of QEP unit 233.

Pulses 83 are integrated in an integrating element (counter) 228, yielding at its output 237 a distance signal Sist that corresponds to the distance traveled by label strip 20.

FIG. 14 shows the various signals. Signals A and A/ are generated by a first signal trace, and signals B and B/ by a signal trace offset therefrom by 90° el.

As depicted in FIG. 14, rotation speed signal nist is generated by differentiating the flanks of signals A/, B/. Signal A1 corresponds to signal A, and signal B1 corresponds to signal B. The phase shift between signals A and B yields the rotation direction of motor 80, as is known to one skilled in the art.

Because a large difference can exist, particularly at the beginning, between Sist (=0) and Ssoll, a corresponding control variable is produced at the output of PI controller 226, and this variable is then limited, if applicable, to a predetermined value in a limiting element 232. (Because the PI controller is preferably digital, this limiting operation is part of the control program. The value to which limiting occurs can here, as also in limiter 250, be variable and adjustable. The limitation becomes effective only if the control variable exceeds the value that is set.)

A setpoint Nsoll for the rotation speed of motor 80 is obtained at the output of limiter 232. This setpoint is compared, in a comparator 234, with the true rotation speed value Nist delivered from output 235 of QEP unit 233.

The output signal of comparator 234 is delivered to a digital PI rotation speed controller 238 at whose output is obtained a control value to which is added, in an adding element 240, the output signals of a feed forward (FF) element 242 for acceleration, and of an FF element 244 for speed Vsoll.

Element 244 (FF Vsoll) receives its input signal from a differentiating element 270, which serves to differentiate over time the setpoint positions furnished by profile generator 220 at its output 223, i.e. to create a speed setpoint dSsoll/dt, and this value is multiplied in element 244 by an empirically ascertained predetermined factor and delivered to adding element 240 as an input variable.

Element 242 (FF acceleration) receives its input signal from a differentiating element 271, which serves to differentiate the speed setpoint calculated in element 270 over time once again, i.e. to calculate a setpoint for the acceleration; and this acceleration setpoint is multiplied in element 242 by an empirically ascertained predetermined factor and then likewise delivered to adding element 240 as an input variable. Element 242 thus multiplies the variable received from elements 270, 271 and delivers it to element 240.

These differentiation operations thus constitute a predictive intervention in the control loop, enhancing both the dynamics of controller 218 and its accuracy when positioning labels 26. This is explained in detail below with reference to FIG. 20.

This is particularly important at location A in FIG. 8, i.e. at the transition from V=0 to rising ramp 176, also at location 177 (transition from rising ramp 176 to region 180 of constant speed), also at location 182 (transition from region 180 to braking ramp 184), and lastly at location A', i.e. at the transition from the active braking portion 184 to a standstill, i.e. to V=0. overshooting or undershooting at locations A, 177, 182, and A' is thereby very largely eliminated, and the transitions proceed substantially asymptotically. The multiplication factors in elements 242, 244 are ascertained empirically and depend, among other factors, on the type of motor 80. The principal result of correct adjustment is that backward rotation of motor 80 at points A and A' becomes almost impossible. Any such backward rotation would lead to a loss of tension in carrier strip 22 and is therefore undesirable.

The end of horizontal region 180 (FIG. 8), i.e. time 182', is calculated predictively in the manner described. The predictive calculations that are preferably used in the present invention result in an increase in the system's dynamics, i.e. they make possible very good positioning accuracy and repeatability at high labeling speeds.

The output signal of element 240 is delivered to a limiter 250, and the control value at the output of limiter 250 serves as the current setpoint isoll for the q axis.

Motor 80, which is also referred to as a synchronous machine with permanent-magnet excitation (PMSM), operates in this exemplifying embodiment with a field-oriented control system (vector control), the field-forming current ("exciting current") and the torque-forming current being regulated separately. The basis of a field-oriented control system of this kind is that the current components that are to be decoupled are impressed into motor 80 by separate current-control loops.

With a control system of this kind, a distinction is made between the so-called d component, also called the direct-axis component or field-forming component, and the q component, also called the quadrature-axis component, of the motor current.

q Component

A linear correlation exists between the torque generated by motor 80 and the quadrature-axis component. Because motor 80 has a permanent-magnet rotor whose rotor flux is constant, the output variable isoll at the output of limiter 250 can be used as a setpoint for the quadrature-axis component. It is compared in a comparator 266 with a variable Iq, and the result of the comparison is delivered to a PI current controller 268.

d Component

Because motor 80 has a permanent-magnet rotor whose magnetic flux is constant, a value of 0 is specified by a sensor 246 for the d component and is delivered to a comparator 258, to whose negative input a value for the current Id is delivered. Motor 80 is therefore regulated here so that the d component has a value of 0.

Motor 80 has three phases u, v, w in its stator winding, and has a permanent-magnet internal rotor (not shown). As described, motor 80 is controlled upon startup as a brushless motor by means of Hall sensors (or, alternatively, according to the sensorless principle), and after starting it operates as a three-phase synchronous motor with approximately sinusoidal currents.

It has for this purpose inverter 86, already described, in the form of a three-phase full bridge, e.g. having IGBT transistors or other controllable semiconductors. Bridge 86 is controlled via optocouplers 90 and gate drivers 88 (cf. FIG. 4).

Currents Iu and Iv in two of the three supply leads u, v, w of motor 80 are sensed via the two current transformers 112, 114 and converted in DSP 116, in an A/D converter provided therein, to digital signals. They are then delivered to a uvw-dq coordinate converter 256, along with the signal Ωist from converter 229. Converter 256 generates therefrom, by transformation, the previously mentioned d-axis current component Id and q-axis current component Iq for the d and q axes, which serve as feedback variables for the two current controllers 260 and 268, respectively.

As already explained, the d-axis current component Id is delivered with a negative sign to summing element 258, to whose positive input a value of 0 is delivered. The output signal of element 258 is delivered to digital PI current controller 260, at whose output a signal Ud is obtained, namely a setpoint for the d-axis voltage Ud, which signal is delivered to a dq-uvw coordinate converter 262 that is also referred to as a space vector modulator or space vector generator.

The output signal iSOLL of limiter 250 is delivered to the positive input of summing element 266, to whose negative input the output signal Iq of converter 256 is delivered. The output signal of comparison element 266 is delivered to a PI current controller 268, at whose output a setpoint for the q-axis voltage Uq is obtained. This value Uq is likewise delivered to dq-uvw coordinate converter 262, to which the rotor position signal Ωist is also delivered; the converter generates from these input signals three signals Uu, Uv, Uw to control the module 86 that energizes motor 80, so that a circulating rotating field is generated in motor 80.

Modules 86, 256, 260, 262, 268 are hardware or software modules that are familiar to one skilled in electrical drive systems. These modules are used, for example, in servocontrollers for motor vehicle steering systems, and in frequency converters. In the exemplifying embodiment, they are in part constituents of DSP 116.

Located in link circuit line 106 (FIG. 4) that leads to module 86 is a measurement resistor (not shown), which makes possible short-circuit sensing and ground-fault sensing in element 110 in order to protect module 86. If a short-circuit pulse exceeds a predetermined length, component 110 shuts off driver 88 and sends a corresponding signal to DSP 116.

FIG. 15 shows the functions of the individual constituents of controller 281. The number 269 designates the current controller that directly influences the sinusoidal currents Iu, Iv, Iw in motor 80.

Current controller 269 is a constituent of a rotation speed controller 271 upon which, as depicted, the setpoint acceleration from element 242 and the setpoint rotation speed nsoll from element 244 act directly.

Lastly, 273 designates a position controller to which a setpoint Ssoll for the position of label strip 20 is delivered directly from profile generator 220, and which causes motor 80 to come to a standstill exactly at the desired location A'.

Element 230 is triggered by label sensor 44. When the latter generates a signal at a label edge 27 (location M in FIG. 8), that signal causes a measurement interrupt, and at that point, in accordance with equation (2), the value S2soll is added to the value S1ist that has been reached and is used as a new target variable Z, as has already been described in detail; the result is that points A, A' do not "wander," i.e. labels 26 are not "offset," and a high level of labeling accuracy is obtained.

FIG. 16 shows a labeler 46 analogous to the one depicted in FIG. 3, except that a printer 280 of known design is installed on table 42. The (adjustable) table 42 is therefore more elongated, and printer 280 is located (as an example) between label sensor 44 and dispensing edge 30. Parts identical, or having functions identical, to those in FIG. 3 are labeled with the same reference characters as therein, and will not be described again.

Because printer 280 is usually controlled by labeling device 46, i.e. in most cases by DSP 116, when printer 280 is connected the program can be modified in such a way that variable Z can be set by the user only to [EL+SB]. This can be accomplished by a corresponding input form on which the type of labeling, label length, and label spacing must be inputted by the user, and target variable Z is set in accordance with those inputs once their plausibility has been checked. If a label 26 is missing from carrier strip 22 at any point, label strip 20 nevertheless comes to a halt, carrier strip 22 is imprinted by printer 280, and transport and, if applicable, imprinting of the carrier strip then occurs again if a second label also happens to be missing.

The advantage achieved with the arrangement depicted in FIG. 16 is that labels 26 can be imprinted in very precisely fitting fashion, because the "correction" or "synchronization" occurs at measurement location M close to printer 280. Waste is thus avoided, and the invention is suitable in the same fashion, for example, for applications in which the only requirement is that labels 26 arranged on a carrier strip 20 be sequentially imprinted inline with very precise fit and at high speed.

FIG. 18 shows housing part 302 of device 46 of FIG. 3 from the back side (with the back wall removed), i.e. looking in the direction of arrow XVIII of FIG. 17. Housing part 302 has two openings 320, 322 that can be used to install it on a machine. FIG. 17 also shows the location of processor 116 in part 300.

Visible in FIG. 18 are motor 80 and its shaft 324, on which a belt pulley 326 (e.g. 14 teeth) for a toothed belt 328 is mounted. The latter passes over a tension pulley 330 to a belt pulley 332 (e.g. 32 teeth) that drives roller 62 (FIGS. 3 and 16). In this example, therefore, one revolution of roller 62 corresponds to 32/14 revolutions of motor shaft 324.

A variety of circuit boards are arranged in housing part 302, e.g. circuit board 94 for the EMC filter, and three further circuit boards 336, 338, 340 having electronic components.

A lateral adjusting wheel 344 allows the position of label sensor 44 to be modified.

FIG. 19 is an enlarged cross-sectional depiction of the unattached end of scoop 307. A portion of motor 80, encoder 82, and board 84 having power module 81 (inverter 86 and rectifier 104 for energizing link circuit 106, cf. FIG. 4) are visible. Inverter 86 and rectifier 104 are manufactured as a complete module 81, for example, by the EUPEC company. Inverter 86 has, for example, six IGBT transistors. This module 81 rests at an end surface 87, on which thermoconductive paste 89 is provided, with a preload against an inner wall 85 of cover 306, so that heat is transferred out of module 81 into cover 306 and from there into tubular part 300, as indicated symbolically by arrows 18.

At the transition from cover 306 to tubular part 300, an 0-ring 303 is provided in a continuous groove 301 in order to join parts 300, 306 to one another in liquid-tight fashion; this is important principally in terms of cleaning with a high-pressure washer, which is used in many facilities. Cover 306 is mounted on tubular part 300 by means of screws 305. Part 300 is also mounted in liquid-tight fashion on housing 302.

A panel 307 is provided in the interior of tubular part 300, extending approximately perpendicular to its longitudinal axis. This panel is equipped with pegs 309 that engage, in the manner depicted, into recesses 311 of module 86, 104.

Panel 307 with its pegs 309 is pressed by springs 311 toward cover 306 with a force of, for example, 150 N, and by its pegs 309 presses module 81 against inner wall 85 of cover 306 so that a low heat transfer resistance is obtained there.

Because cover 306 is particularly thick in the region of module 86, 104, its thermal capacity at that point is sufficient that local overheating can reliably be avoided even when the labeling device is under heavy load.

As is evident from FIG. 19, lower screw 305 is embodied in two parts. Its inner part 305i serves, as depicted, to guide panel 307 and circuit board 84, both of which are provided with corresponding cutouts for the purpose.

FIG. 20 explains the working principle of position controller 273 that is used. The vertical axis shows distance S traveled by label strip 20. The horizontal axis shows time t; one labeling cycle can last, for example, 12 ms. Within that time, label strip 20 must be transported from a location A to a location A', e.g. a distance of 20 mm, corresponding to variable TW. The average speed of label strip 20 that results is then $$0.02\ m/0.012\ s=1.7\ m/s=100\ m/min.$$

Within this time span of, for example, 12 ms, label strip 20 must stringently comply with a prescribed motion protocol, since correct labeling, "on the fly," of products passing by would otherwise be impossible; in other words, the position controller must be a very "stiff" one that reaches the setpoint speed Vsoll exactly within a prescribed time period and also maintains that setpoint speed for a prescribed time span exactly, i.e. at a very consistent speed.

This compliance with a predetermined motion protocol is achieved by the fact that during labeling, controller 218 is preferably operated continuously in the position control mode, the values for the setpoint acceleration and setpoint rotation speed becoming even more strongly effective at vertices 177, 182 (FIG. 8) of the profile, because those values abruptly change there.

For this purpose, a speed profile V=f(t) and a position profile S=g(t) are calculated from the data that are delivered, i.e. Δ1, Δ2, TW, and Vsoll. FIG. 20 shows, by example, one such position profile S=g(t). Because the profile V=f(t) is easier to define and to recalculate (for example if parameters change), the position profile is preferably derived from the speed profile; this can be done with simple calculation operations, as one skilled in the art will immediately recognize.

For example, it is known from the position profile of FIG. 20 that a distance of 4 mm must be covered after a time t1, and a distance of 16 mm after a time T=TW/Vsoll; and that label strip 20 must have come to a standstill after moving 20 mm.

These distance data are resolved into small increments Δt and ΔS, e.g. of Δt=500 μs; and profile generator 220 specifies to controller 273, for example at a location 300 (FIG. 20), that in the next 500 μs, strip 20 must have proceeded over a distance increment ΔS of 1.4 mm and must have reached location 302 (5.4 mm) (corresponding to a setpoint speed of 2.8 m/s). At location 302, since speed Vsoll is constant there, profile generator 220 accordingly once again specifies to controller 273 that strip 20 must have covered another ΔS=1.4 mm within the next Δt of 500 μs, and reached a location 304 (6.8 mm), and so forth.

The working principle of a digital position controller of this kind, as indicated by the description above, is therefore that of "traversing" to a closely-packed succession of predetermined positions in accordance with a precisely defined time sequence.

The predetermined profile is thus "traversed" in a rapid succession of instructions, the result of the selected controller configuration, with a subordinate speed controller and current controller, being that the motion follows the predetermined pattern very exactly.

No overshoots therefore occur at the transition points, e.g. at locations 177 and 182 in FIG. 8, since a controller of this kind, so to speak, automatically "irons out" or "evens out" the sharp edges there. This is achieved principally by the fact that in FIG. 13, summing element 240 at the output of PI controller 238 has delivered to it, as correction values, the setpoint acceleration from element 242 and the setpoint rotation speed from element 244.

When, for example, at location 177 in the profile in FIG. 8, the setpoint acceleration decreases from a positive value to zero (since as of point 177 the strip speed Vsoll is constant), the input signal of PI current controller 268 then drops correspondingly, and the motor current is immediately reduced so that an overshoot does not occur.

Similarly, at location 177 the setpoint Vsoll for the strip speed becomes constant, while prior to point 177 it was continuously rising.

The result of both facts is that at point 177 the strip motion transitions without overshooting into portion 180 having a constant speed Vsoll; this is very important, for example, for correct labeling of objects (P in FIG. 3) that are passing by.

Analogously, at location 182 (FIG. 8) the setpoint acceleration, which previously had a value of zero, becomes negative, with the result that the controller transitions almost immediately, and without overshooting, into braking mode; also contributing to this is the fact that as of location 182, the setpoint Vsoll for the strip speed continuously decreases.

The signals from PI controller 226 bring about continuous position control, so that a strip speed of zero is reached at location A'. A digital position controller of this kind is thus a very effective way of achieving a predetermined distance profile, and indirectly a predetermined speed profile, with no overshooting.

The size of the steps At used by the controller, i.e. the so-called cycle time, is normally shortest in current controller 269, since the motor current can change most quickly.

FIG. 20 indicates by example that the time span T (cf. FIGS. 9 to 11) can have a value TW/Vsoll. This corresponds to the example of FIGS. 9 to 11. In a different profile, of course, the time span T can have a different value, as explained in detail with reference to FIGS. 9 to 11.

At measurement location M (FIG. 8) a new value Z is used instead of TW, and in this case a new value for T $$T'=Z/Vsoll \tag{8}$$

can result if TW is not identical to Z, and provided the example according to FIGS. 9 to 11 is taken as the basis. In this case, a new time 182' is also calculated.

Reference characters 176, 180, and 184 in FIG. 20 refer to the corresponding portions of the depiction in FIG. 8, and are intended to facilitate comparison between the depictions of FIGS. 8 and 20.

Many variants and modifications are of course possible within the scope of the present invention without departing from the basic concept of the invention. For example, a portion of the motion profile could be generated by a speed controller.

What is claimed is:

1. A method of moving a label strip (20), on which are arranged labels (26) of predetermined length (EL) with substantially uniform interstices (SB), by means of an electric motor (80), a position controller (218) associated with that motor, and a sensor (44) for sensing a predetermined position of a label (26) when the latter is moved on the label strip (20) relative to the sensor (44), comprising the steps of:

in accordance with a predetermined motion profile, setting in motion the label strip (20), beginning from a start position (A), a first target position (Z) of the label strip (20) being specified to the position controller (218);

during the motion of the label strip (20), sensing a predetermined position (M) of the label strip (20);

in close chronological conjunction therewith, specifying a revised target position (Z) to the position controller (218);

calculating, from the predetermined motion profile, a plurality of position values (S; 300, 302, 304) of the label strip (20), and a respective time value associated with each position value, defining each respective position value and time value as a value pair, and successively delivering those value pairs to the position controller (273) as setpoints for position regulation.

2. The method according to claim 1, wherein the position controller (218) has specified to it, as the first target position (Z), a motion over to a predetermined distance that corresponds approximately to the magnitude n * [EL +SB], where EL corresponds to the length of a label (26), SB corresponds to the spacing between two successive labels (26), and n is a positive integer. [=1, 2, 3, . . . ]

3. The method according to claim 1, wherein the predetermined motion profile comprises a starting ramp (176) having a substantially predetermined shape; a motion phase (180; 180'), following the starting ramp, with a substantially constant advance speed (Vsoll); and a shutdown ramp (184) having a substantially predetermined shape.

4. The method according to claim 3, further comprising sensing the predetermined position (M) of the label strip (20) in a time range (180') in which the label strip (20) is being driven at the substantially uniform advance speed (Vsoll).

5. The method according to claim 3, wherein the substantially constant advance speed is a regulated advance speed (Vsoll).

6. The method according to claim 3, wherein the substantially constant advance speed (Vsoll) is specified by an element (140) that controls the motion of objects (P) to be labeled.

7. The method according to claim 1, wherein the electric motor (80) is implemented with three phases, and is started by commutation in the manner of a brushless motor and then switched over to sine-wave commutation.

8. The method according to claim 1, further comprising operating the controller with a subordinate current controller, to whose input a signal influenced by the setpoint acceleration is delivered, in order to enable a rapid change in the motor current, in the context of changes in the setpoint acceleration.

9. An arrangement for moving a label strip on which labels (26) of predetermined length (EL) are arranged with substantially uniform spacings (SB), which arrangement comprises:

an electric motor (80);

a position controller (218) associated with that motor (80);

a sensor (44) for sensing a predetermined position (M) of a label (26) when the label strip (20) is moved past the sensor (44);

a profile generator (220) which calculates, from a predetermined motion profile, a plurality of position values (S) of the label strip (20), and time values associated with those position values (S) in the manner of value pairs, those value pairs serving as setpoints for position regulation; and a control arrangement that sets the label strip (20) in motion, beginning from a start position (A), according to said predetermined motion profile, a first target position (Z) of the label strip (20) being specified to the position controller as a first target variable, and that senses a predetermined position (M) of the label strip (20) during the motion of the label strip (20) and, subsequently thereto, specifies a revised target position (Z) to the position controller (218) as a new target variable.

10. The arrangement according to claim 9, wherein the position controller (218) has specified to it, as a first target position (Z), a motion over a predetermined distance that corresponds approximately to the magnitude n * [EL +SB], where EL corresponds to the length of a label (26), SB to the spacing between two successive labels (26), and n is a positive integer. [=1, 2, 3, . . . ]

11. The arrangement according to claim 9, wherein the predetermined motion profile comprises a starting ramp (176) having a substantially predetermined shape;

a motion phase (180; 180'), following the starting ramp (176), with a substantially uniform advance speed (Vsoll);

and a shutdown ramp (184) having a substantially predetermined shape.

12. The arrangement according to claim 9, wherein the determination of the predetermined position of the label strip (20) takes place in a time range (180') in which the label strip (20) is being driven at the substantially uniform advance speed (Vsoll).

13. The arrangement according to claim 11, wherein the substantially uniform advance speed is a regulated advance speed (Vsoll).

14. The arrangement according to claim 11, wherein an element (140) is provided that controls the motion of objects (P) to be labeled, and wherein the substantially uniform advance speed (Vsoll) is specified by that element (140).

15. The arrangement according to claim 9, wherein the electric motor is a three-phase internal-rotor motor (80).

16. The arrangement according to claim 15, wherein for starting, the three-phase motor (80) has, associated with it, a commutation device and an apparatus (82) for furnishing rotor position signals, in order to start the motor (80) in the manner of a brushless DC motor.

17. The arrangement according to claim 16, wherein the three-phase motor (80) has associated with it an arrangement (256, 260, 262, 268) for sine-wave commutation that is switched on after the motor (80) is started.

18. The arrangement according to claim 9, wherein the electric motor (80) has associated with it a resolver that furnishes at least 1,000 pulses per motor revolution.

19. The arrangement according to claim 9, wherein the controller comprises a subordinate current controller to whose input a signal influenced by the setpoint acceleration is delivered, in order to enable a rapid adaptation of the motor current in the context of changes in the setpoint acceleration.

20. A method of moving a label strip (20) from a start position (A) to a target position (A') by means of an electric motor (80), on which label strip (20) are arranged labels (26) of predetermined length (EL) with substantially uniform interstices (SB), comprising the steps of:

using a controller (218) associated with the electric motor (80) to impart, to the label strip (20), a motion profile which comprises, as a first phase, a starting ramp (176) of defined shape and, as a second phase, a portion (180, 180'), subsequent to the starting ramp (176), having a substantially uniform speed (Vsoll), based on predetermined data that are the basis for the motion profile, calculating a future point in time (182; 182') for a transition from the second phase to a third phase;

approximately after said future point in time (182; 182') is reached, in the third phase (184), braking the label strip in position-controlled fashion by the motor (80) in such a way that the label strip reaches a speed of zero substantially at the target position (A'), and wherein, upon specification of a modified speed characteristic (Vsoll) in the second phase (180, 180'), an integral (∫V dt) defined by a speed profile is kept substantially constant.

21. The method according to claim 20, further comprising defining the imparted motion profile, at least in part, by a profile in which a sequence of setpoint positions (S) of the label strip (20) is specified as a function of time.

22. The method according to claim 20, wherein the integral (∫V dt) defined by the entire speed profile is kept substantially constant by recalculating the future point in time (182; 182').

23. The method according to claim 20, wherein during the first phase, the speed profile is defined by a substantially constant acceleration (Δ1) of the label strip (20).

24. The method according to claim 20, wherein, during the third phase, the speed profile is defined by a substantially constant deceleration (Δ2) of the label strip.

25. The method according to claim 20, wherein, in the third phase (184), a motion of the label strip (20) opposite to the direction (29) occurring in the context of an advance motion is at least impeded.

26. The method according to claim 25, wherein in the third phase (184), a rotation of the electric motor (80) opposite to the motion direction (29) executed by the label strip (20) in the context of an advance motion is at least impeded.

27. The method according to claim 20, wherein the electric motor (80) is configured with three phases and is started using commutation in the manner of a brushless motor, and then switched over to sine-wave commutation.

28. The method according to claim 20, wherein the controller operates with a subordinate current controller to whose input a signal influenced by the setpoint acceleration is delivered, in order to enable a rapid change in the motor current in the context of changes in the setpoint acceleration.

29. An arrangement for moving a label strip (20) from a start position (A) to a target position (A'), which arrangement comprises:

an electric motor (80) for effecting a motion of the label strip (20);

a control arrangement (218) for controlling the motion of the electric motor (80), and thus of the label strip (20), in the manner of a four-quadrant controller, which control arrangement (218) is implemented to impart to the label strip (20) a motion profile which comprises as a first phase, a starting ramp (176) in which the label strip (20) experiences an acceleration, as a second phase, a portion (180, 180') subsequent to the starting ramp (176) having a substantially uniform speed (Vsoll), and as a third phase, a portion (184) in which the electric motor (80) brakes the label strip (20) in position-controlled fashion in such a way that it reaches a speed of zero approximately at the target position (A'); and the imparted motion profile is defined, at least in part, by a speed profile in which, as a function of time, a specific speed of the label strip (20) is at least approximately specified in each case.

30. The arrangement according to claim 29,
wherein the control arrangement (218) is implemented to calculate, based on data that are the basis for the motion profile, a future transition time (182') in whose chronological vicinity the control arrangement (218) brings about the transition from the second phase (180, 180') to the third phase (184).

31. The arrangement according to claim 29, wherein, in the context of a change in the speed (Vsoll) specified for the second phase (180, 180'), the control arrangement (218) is implemented to keep the integral (∫V dt]defined by the entire speed profile substantially constant.

32. The arrangement according to claim 31,
wherein the control arrangement (218) is implemented to keep the integral (∫V dt) defined by the entire speed profile substantially constant by recalculating the transition time (182').

33. The arrangement according to claim 31,
wherein during the first phase, the speed profile is defined by a substantially constant acceleration (Δ1) of the label strip (20).

34. The arrangement according to claim 31,
wherein during the third phase (184), the speed profile is defined by a substantially constant deceleration (Δ2) of the label strip (20).

35. The arrangement according to claim 29, wherein the control arrangement (218) is implemented at least to impede, in the third phase (184), a motion of the label strip (20) opposite to the direction (29) occurring in the context of an advance motion.

36. The arrangement according to claim 35,
wherein the control arrangement (218) is implemented at least to impede, in the third phase (184), a rotation of the electric motor (80) opposite to the motion direction (29) executed by the label strip (20) in the context of an advance motion.

37. The arrangement according to claim 29,
wherein the control arrangement is implemented to calculate, from a predetermined motion profile, a plurality of position values (S) of the label strip (20), and time values associated with those position values (S) in the manner of value pairs, which value pairs are deliverable to a position controller (273) for the position of the label strip (20).

38. The arrangement according to claim 37,
wherein the value pairs are deliverable to the position controller (273) in a predetermined chronological sequence.

39. The arrangement according to claim 29, wherein the electric motor is implemented as a three-phase internal-rotor motor (80).

40. The arrangement according to claim 39,
wherein the three-phase motor (80) has associated with it a commutation device operating with rotor position signals, in order to start the motor in the manner of a brushless DC motor.

41. The arrangement according to claim 40,
wherein the three-phase motor (80) has associated with it an arrangement (256, 260, 262, 268) for sine-wave commutation that is automatically switched on when the motor (80) is rotating.

42. The arrangement according to claim 29,
wherein the electric motor (80) has associated with it a resolver that furnishes at least 1,000 pulses per motor revolution.

43. The arrangement according to claim 29,
wherein the controller comprises a subordinate current controller to whose input a signal influenced by the setpoint acceleration is delivered, in order to enable a rapid change in the motor current in the context of changes in the setpoint acceleration.

44. An arrangement for repeatedly moving a label strip (20) from a starting position (A) to a target position (A'), on which label strip (20) are arranged labels (26) of predetermined length (EL) with substantially uniform interstices (SB), which arrangement comprises:
an electric motor (80);
a position controller (218) associated with the electric motor (80) and implemented as a four-quadrant controller,
the label strip (20) having imparted to it during its motion, by the position controller (218), a motion profile which comprises
as a first phase, a starting ramp (176) with a defined acceleration (Δ1);
as a second phase, a portion (180, 180'), subsequent to the starting ramp, with a substantially constant speed (Vsoll); and
as a third phase, a braking ramp (184) with a substantially predetermined deceleration (Δ2),
and in which, in the third phase, the label strip (20) is braked in position-controlled fashion to a speed of zero at a predetermined location (A'), and any motion of the label strip, opposite to motion which occurs in the context of advance motion, is suppressed.

45. The arrangement according to claim 44,
wherein the position controller (218) is implemented in such a way that in the third phase (184), a rotation of the electric motor (80) opposite to the motion direction (29) executed by the label strip (20) in the context of its advance motion is suppressed.

46. The arrangement according to claim 44,
wherein the control arrangement is implemented to calculate, from a predetermined motion profile, a plurality of position values (S) of the label strip (20), and time values associated with those position values (S) in the manner of value pairs, which value pairs are deliverable to a position controller (273) for the position of the label strip (20).

47. The arrangement according to claim 44,
wherein the position controller comprises a subordinate current controller for the motor current, to whose input a signal influenced by the setpoint acceleration is delivered in order to enable a rapid change in the motor current in the context of changes in the setpoint acceleration.

48. The arrangement according to claim 44,
wherein the motor is implemented as a three-phase internal-rotor motor (80).

49. The arrangement according to claim 48,
wherein the three-phase motor (80) has, associated with it, a commutation device that starts the motor (80) in the manner of a brushless DC motor.

50. The arrangement according to claim 49,
wherein the three-phase motor (80) has, associated with it, an arrangement (256, 260, 262, 268) for sine-wave commutation that is switched on after the motor (80) is started.

51. The arrangement according to claim 44,
wherein the electric motor (80) has, associated with it, a resolver that furnishes at least 1,000 pulses per motor revolution.

* * * * *